US008838000B2

(12) United States Patent
Tamura

(10) Patent No.: US 8,838,000 B2
(45) Date of Patent: Sep. 16, 2014

(54) IMAGE HEATING DEVICE

(71) Applicant: Canon Kabushiki Kaisha, Tokyo (JP)

(72) Inventor: Shuichi Tamura, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 13/657,206

(22) Filed: Oct. 22, 2012

(65) Prior Publication Data

US 2013/0108337 A1 May 2, 2013

(30) Foreign Application Priority Data

Oct. 26, 2011 (JP) ..... 2011-234895

(51) Int. Cl.
*G03G 15/20* (2006.01)

(52) U.S. Cl.
CPC ..... *G03G 15/2053* (2013.01)
USPC ..... 399/328; 399/330

(58) Field of Classification Search
None
See application file for complete search history.

(56) References Cited

U.S. PATENT DOCUMENTS

2005/0067407 A1* 3/2005 Tanino et al. ..... 219/619
2010/0178088 A1 7/2010 Koshida et al.

FOREIGN PATENT DOCUMENTS

JP 5-009027 B 2/1993
JP 9-306651 A 11/1997
JP 2003-084587 A 3/2003
JP 2004-198866 A 7/2004
JP 2010-160388 A 7/2010
JP 2010-217580 A 9/2010
WO 03/039197 A1 5/2003

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

In an image heating device (F) employing an induction heating system, which includes a heating rotary member (15, 15A) and a magnetic flux generating unit including a coil and a magnetic core (12), when an area of a surface of a leading end portion of the core (12) on a side opposed to the heating rotary member (15) is large, the time change of the magnetic flux to act on the heating rotary member does not increase. As a result, the heat generation efficiency of the heating rotary member may be suppressed. To resolve this problem, the core (12) includes a second core portion (12*a*) protruding toward the heating rotary member and including, on a leading end side of a convex-shaped part, a leading end protruding portion (12*d*) which has a width smaller than a width of a root portion (12*b*) of the convex-shaped part in a circumferential direction.

10 Claims, 16 Drawing Sheets

IMAGE HEATING DEVICE

BACKGROUND OF THE INVENTION

1. Field of the Invention

The present invention relates to an image heating device employing an induction heating system, which heats a toner image on a recording material. The image heating device may be used in an image forming apparatus such as a copying machine, a printer, a facsimile machine, and a multifunctional peripheral having multiple functions thereof.

2. Description of the Related Art

Hitherto, in an electrophotographic fixing device (image heating device), fixing processing (heating processing) has been performed by pressurizing and heating a toner image formed on a recording material at a nip portion between a fixing roller (heating rotary member) and a pressure roller.

As measures that respond to the demand for energy saving of recent years, there has been proposed a fixing device employing an induction heating system that uses high-frequency induction as a heating source (Japanese Patent Application Laid-Open No. 2010-160388). This induction heating device includes a magnetic flux generating unit including an exciting coil and a magnetic core. With the high-frequency magnetic field generated by causing a high-frequency current to flow through the exciting coil, an induction eddy current is generated in the fixing roller (heating rotary member), and thus the fixing roller itself generates Joule heat by its skin resistance. When a leading end portion of the magnetic core opposed to the fixing roller has a large thickness in its circumferential direction, it is difficult to increase the maximum magnetic flux density of the magnetic flux acting to the fixing roller. As a result, the time rate of change of the magnetic flux acting to the fixing roller does not increase, and hence the heat generation efficiency may be reduced. When the core opposed to the fixing roller is thinned from its root, it becomes difficult to maintain the strength of the core itself.

SUMMARY OF THE INVENTION

According to the present invention, it is possible to provide an image heating device employing an induction heating system, in which heat generation efficiency of a heating rotary member is improved while maintaining the strength of a core itself.

The present invention provides an image heating device, including: a coil for generating a magnetic flux; a heating rotary member which generates heat by the magnetic flux generated from the coil and heats an image on a recording material; a first core portion curved along a circumferential direction of the heating rotary member; and a second core portion extending toward the heating rotary member, the second core portion having a leading end portion which is opposed to the heating rotary member and a root portion, and the leading end portion having a thickness thinner than a thickness of the root portion in the circumferential direction of the heating rotary member.

Further features of the present invention will become apparent from the following description of exemplary embodiments with reference to the attached drawings.

DESCRIPTION OF THE EMBODIMENTS

In the following, with reference to the drawings, specific examples of embodiments (exemplary embodiments) of the present invention are described, but the present invention is not limited to the exemplary embodiments below.

First Embodiment (1) Example of Image Forming Apparatus

Figure 1:
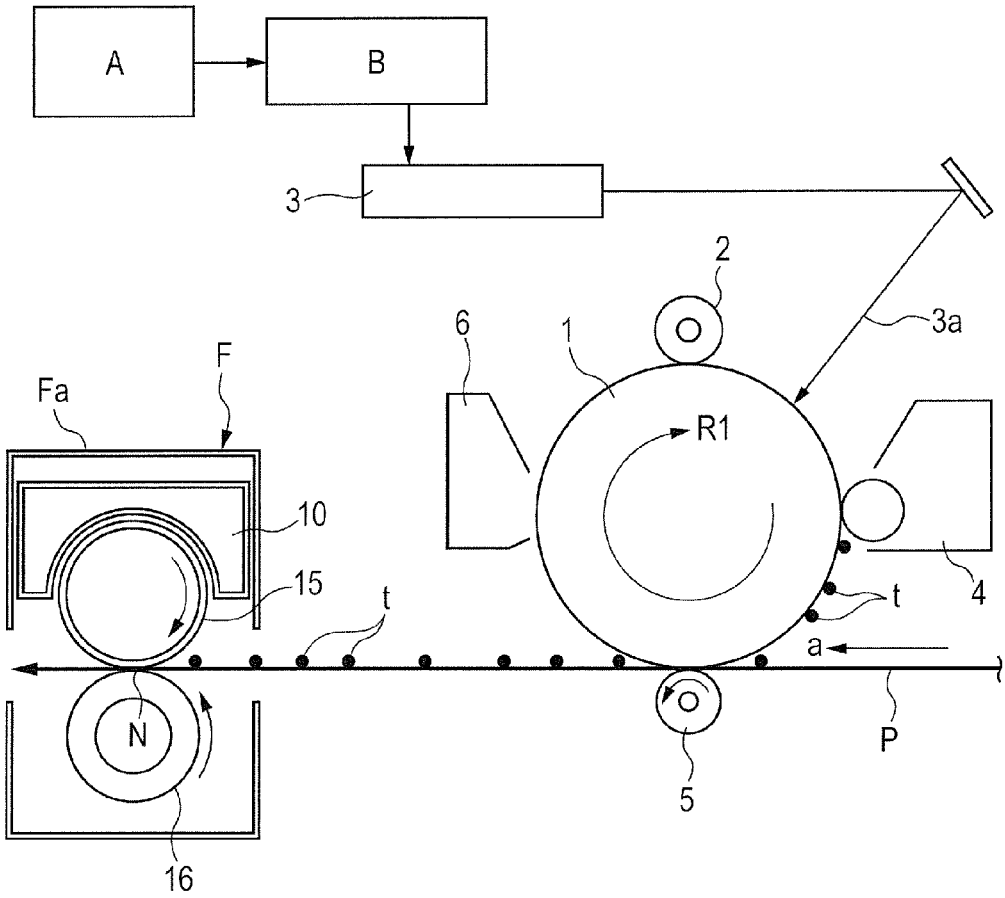
FIG. 1 is a schematic view of a configuration of an image forming apparatus according to a first embodiment.

FIG. 1 is a schematic view of a configuration of an image forming apparatus including an image heating device employing an induction heating system as a fixing device F according to a first embodiment. This image forming apparatus is a digital image forming apparatus (such as a copying machine, a printer, a facsimile machine, and a multifunctional peripheral having multiple functions thereof) employing a laser scanning-exposure system which uses an electrophotographic process.

A rotating drum type photosensitive member 1 (hereinafter referred to as "drum") as an image bearing member is rotated and driven at a predetermined circumferential speed in a clockwise direction of an arrow R1. A primary charging device 2 uniformly charges the peripheral surface of the rotating drum 1 to a predetermined negative dark potential Vd. A laser beam scanner 3 is an image exposure unit. This scanner 3 outputs a laser beam 3*a* modulated correspondingly to a digital image signal input to a control circuit section B from a host device A such as an image reading device and a computer, to thereby scan and expose the uniformly charged processing surface of the drum 1.

With this scanning and exposure, the potential absolute value at the exposed part of the drum 1 decreases to a light potential V1, and an electrostatic latent image corresponding to the image signal is formed on the surface of the drum 1. A developing device 4 causes negatively-charged toner to adhere to the exposed light potential V1 part of the drum surface so that the electrostatic latent image is visualized as a toner image t.

A sheet-like recording material P fed from a sheet feeding section (not shown) is conveyed, at an appropriate timing, to a transfer section in which a transfer roller 5 as a transfer member, to which a transfer bias is applied, and the drum 1 are provided in pressure contact with each other. The toner image t on the surface of the drum 1 is sequentially transferred onto the surface of the recording material P.

The recording material P having the toner image t formed thereon is separated from the surface of the drum 1, and is then introduced to the fixing device (IH fixing device) F as a fixing unit for heating and fixing an unfixed image on the recording material. In the process of being nipped and conveyed at a fixing nip portion N, the toner image t is fixed as a fixing image on the recording material P by heat and pressure, and the recording material P is discharged outside the device as an image formation product. After the recording material P is separated from the drum 1, transfer residual toner remaining on the drum surface is cleaned by a cleaning device 6, and the drum 1 is repeatedly used for image formation.

(2) Overall Description of Fixing Device F

Figure 2:
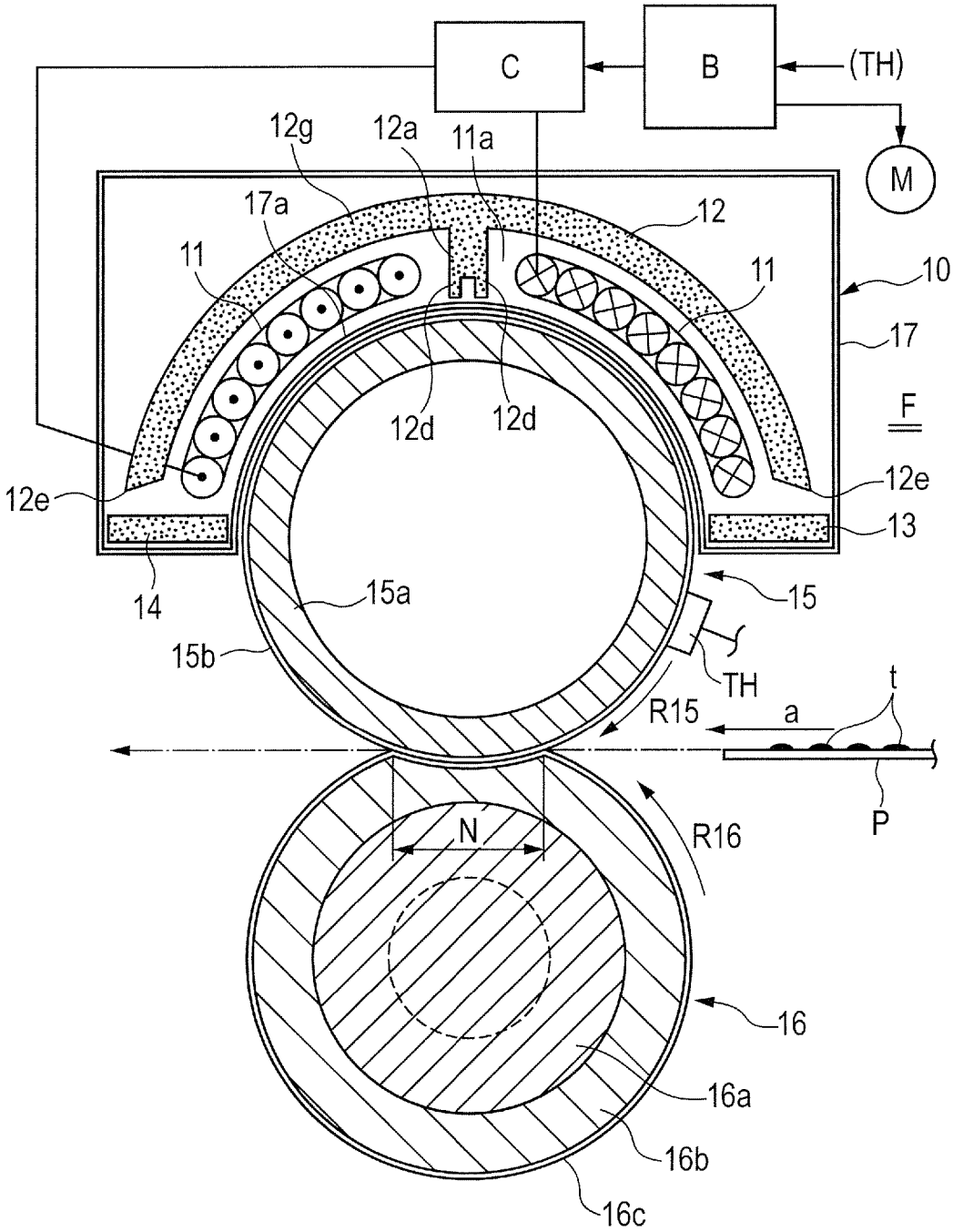
FIG. 2 is a schematic lateral sectional view of a main part of a fixing device.

FIG. 2 is a schematic lateral sectional view of a main part of the fixing device F. The fixing device F includes at least an induction heat generating member and is an outside heating type image heating device employing an induction heating system. In the fixing device F, a heating assembly 10 as a magnetic flux (magnetic field) generating unit is arranged outside a fixing roller 15 as a rotatable heating rotary member to be brought into contact with the recording material P bearing the toner image t.

Regarding the fixing device F, a front side refers to a side when the device F is viewed from a recording material entering side, a rear side refers to a side opposite to the front side (recording material exiting side), and left and right sides respectively refer to left and right sides when the device F is viewed from the front side. Upper and lower sides refer to upper and lower sides in the gravity direction, respectively. Upstream and downstream sides refer to upstream and downstream sides in a recording material conveyance direction "a", respectively. A width direction of the fixing device F or its components refers to a direction orthogonal to the recording material conveyance direction "a" in which the recording material is conveyed.

In this embodiment, the fixing roller 15 includes, as a base member (metal base member) 15*a*, a cylindrical (pipe-like) rigid member made of a ferromagnetic material (metal having high magnetic permeability: magnetic member) such as iron, which corresponds to the induction heat generating member. The outer peripheral surface of the base member is covered with a heat-resistant release layer 15*b* made of, for example, a fluorine resin, for improving releasing performance with respect to the toner. As necessary, another functional layer such as an elastic layer may be interposed between the metal base member 15*a* and the release layer 15*b*.

The base member 15*a* as the induction heat generating member of the fixing roller 15 is formed using a ferromagnetic metal, and thus a magnetic flux generated from the heating assembly 10 can be confined inside the metal as much as possible. That is, the magnetic flux density can be increased, and thus it is possible to generate an eddy current on the metal surface to efficiently heat the fixing roller 15.

The fixing roller 15 is arranged so that both right and left end portions thereof are rotatably supported by right and left side plates (not shown) of a casing Fa (FIG. 1) of the fixing device through intermediation of bearing members, respectively. The fixing roller 15 is rotated and driven at a predetermined circumferential speed in a clockwise direction of an arrow R15 by a fixing motor M as a drive source controlled by the control circuit section B.

Below the fixing roller 15, a pressure roller 16 is arranged as a rotatable image pressurizing member in parallel with the fixing roller 15. The pressure roller 16 is an elastic roller in which a heat-resistant elastic layer 16*b* and a release layer 16*c* are laminated in this order on an outer peripheral surface of a core metal 16*a*. The pressure roller 16 is arranged so that both right and left end portions thereof are rotatably supported by the right and left side plates of the casing Fa through intermediation of bearing members, respectively. The right and left bearing members are arranged so as to be slidable in the up-down direction with respect to the side plates, respectively, and are each moved and biased upward by a pressure unit (not shown).

With this, the pressure roller 16 is provided in pressure contact with the fixing roller 15 at a predetermined pressing force against the elasticity of the elastic layer 16*b*. With this pressure contact, the nip portion (fixing nip portion) N having a predetermined width is formed between the fixing roller 15 and the pressure roller 16 in a roller circumferential direction (recording material conveyance direction "a"). The pressure roller 16 rotates while being held in pressure contact with the fixing roller 15 in a counterclockwise direction of an arrow R16 in accordance with the rotation and drive of the fixing roller 15. Other device configurations are also possible, such as rotating and driving the pressure roller 16 so that the fixing roller 15 is driven to rotate, or rotating and driving both the fixing roller 15 and the pressure roller 16.

The heating assembly 10 as the magnetic flux generating unit is a heating source (induction heating unit) that inductively heats the fixing roller 15, and is arranged above the fixing roller 15 while being positioned and fixed between the right and left side plates of the casing Fa. The assembly 10 includes a housing (casing) 17 as a holder that is long along a longitudinal direction of the fixing roller 15. Inside the housing 17, an exciting coil 11 (hereinafter referred to as "coil"), and magnetic cores 12, 13, and 14 each made of a magnetic material are incorporated.

The housing 17 is a heat-resistant resin molded product having a laterally long box shape in which the right-left direction is the longitudinal direction, and a bottom plate 17*a* is the surface opposed to the fixing roller 15. The bottom plate 17*a* is curved inward of the housing in its lateral cross-section so that the bottom plate 17*a* covers along substantially half of the outer peripheral surface of the fixing roller 15. The housing 17 is arranged so that the bottom plate 17*a* thereof is opposed to the upper surface of the fixing roller 15 with a predetermined gap therebetween, and right and left sides thereof are fixed to the right and left side plates of the casing Fa by fixing units, respectively.

Figure 3:
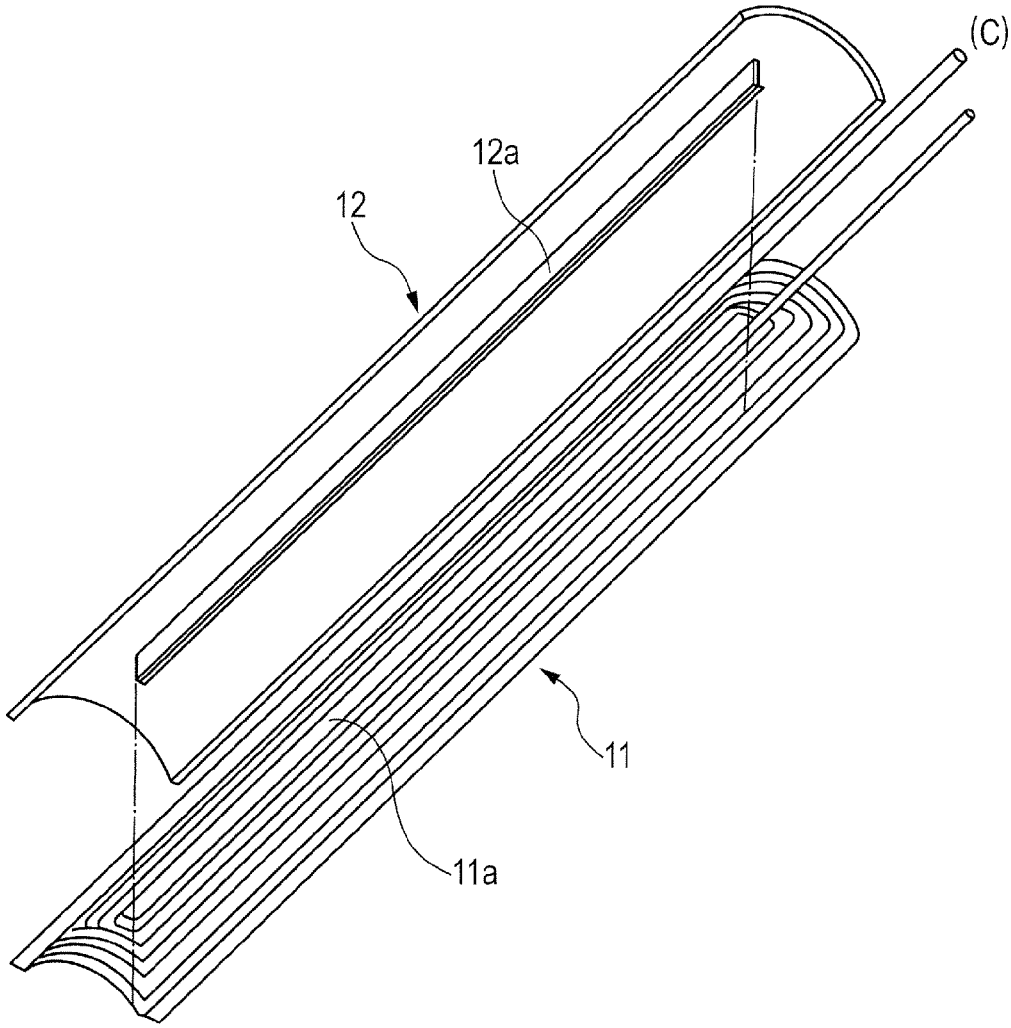
FIG. 3 is a perspective view of an exciting coil and a main core of a magnetic flux generating unit.

The coil 11 has, as illustrated in the perspective view of FIG. 3, a substantially elliptical shape (laterally-long boat shape) that is long in the right-left direction. Moreover, the coil 11 is housed inside the housing so as to be placed on the inner surface of the housing bottom plate 17*a*, that is curved inwardly of the housing, along the outer peripheral surface of the substantially upper half part of the fixing roller 15. That is, the coil 11 is long along the longitudinal direction of the fixing roller 15 and arranged opposed to a maximum paper-passing width area of the recording material P on the surface of the fixing roller 15. The coil 11 uses, as a core wire, a Litz wire formed by bundling about 80 to 160 thin wires each having a diameter of 0.1 mm to 0.3 mm. An insulating covered electric wire is used as the thin wire. The coil 11 is formed by winding the Litz wire 8 to 12 times.

The cores 12, 13, and 14 are used for increasing the efficiency of the magnetic circuit and for magnetic screening. That is, the cores 12, 13, and 14 cover the outer side of the coil 11 on a side opposite to the side of the fixing roller opposing surface of the coil 11 so that the alternating magnetic flux generated by the coil 11 is efficiently introduced to the metal base member 15*a* as the induction heat generating member of the fixing roller 15 substantially without leakage to parts other than the base member 15*a*. The cores 12, 13, and 14 may be made of a material having high magnetic permeability and low residual magnetic flux density such as ferrite.

The outside main core 12 is arranged along the outer surface of the coil 11. The core 12 includes a first core portion 12*g* and a second core portion 12*a*. The first core portion 12*g* is a curved part positioned on the outer surface side of the coil 11 and is curved along the outer surface of the coil 11. The second core portion 12*a* is positioned at a winding center portion inside the winding of the coil, and protrudes from the first core portion 12*g* toward the fixing roller 15. The core 12 is a core arranged along the fixing roller 15 in a rotating direction of the fixing roller 15 as the heating rotary member, and can cover the outer surface side of the coil 11 having a laterally-long boat shape that is long in the right-left direction.

The second core portion 12*a* is positioned at the center portion on an inner surface side of the core 12 in a circumferential direction. The second core portion 12*a* is inserted into a winding center portion (laterally-long slit shaped hole portion) 11*a* of the coil 11 to be opposed to the fixing roller 15. That is, the coil 11 has a form which is wound with the second core portion 12*a* as a base axis, and the core 12 surrounds the winding center portion 11*a* and the outer periphery of the coil 11.

The sub-core 13 is arranged near front edge portions of the coil 11 and the outside main core 12 along the longitudinal direction of the edge portions, and is a member having a substantially rectangle shape in lateral cross-section with the length dimension substantially the same as that of the outside main core 12. That is, the sub-core 13 is a portion (third core portion) extending toward the fixing roller outside the winding of the coil 11. The sub-core 14 is arranged near rear edge portions of the coil 11 and the outside main core 12 along the longitudinal direction of the edge portions, and is a member having a substantially rectangle shape in lateral cross-section with the length dimension substantially the same as that of the outside main core 12. The sub-cores 13 and 14 each have a shape in which a leading end portion opposed to the fixing roller and a root portion thereof have the same thickness. Further, the leading end portion of each of the sub-cores 13 and 14, which is opposed to the fixing roller, is not provided with a protrusion.

The coil 11 is electrically connected to an exciting circuit (electromagnetic induction heating drive circuit, high-frequency converter) C to be controlled by the control circuit section B. At a substantially center portion in a width direction of the fixing roller 15, a contacting or non-contacting type thermistor (temperature detecting unit) TH for detecting the surface temperature of the fixing roller 15 is arranged opposed to the outer surface of the fixing roller 15. An electric signal relating to the temperature detected by this thermistor TH is input to the control circuit section B.

In this embodiment, the recording material P in various large and small width sizes is introduced into the fixing device F by center reference conveyance in which the center of the recording material width is set as a base line. Therefore, the thermistor TH for detecting the surface temperature of the fixing roller 15 is arranged at least within a region of the fixing roller 15 with a width that a minimum width size recording material available in the device F may pass.

The control circuit section B drives the fixing motor M at a predetermined control timing based on the input of an image formation start signal. With this, the fixing roller 15 is driven, and the pressure roller 16 is driven to rotate. Further, the control circuit section B turns ON the exciting circuit C. With this, a high-frequency current flows through the coil 11. With the alternating magnetic flux generated by the coil 11, the metal base member 15*a* as the induction heat generating member of the fixing roller 15 is inductively-heated so that the temperature of the fixing roller 15 rises.

That is, the coil 11 generates the alternating magnetic flux by the alternating current supplied from the exciting circuit C. The alternating magnetic flux is guided by the cores 12 to 14 to act on the fixing roller 15, and thus an eddy current is generated in the metal base member 15*a*. With this eddy current, the metal base member 15*a* as the induction heat generating member generates Joule heat by its specific resistance. As described above, the alternating current is supplied to the coil 11, and the generated magnetic flux acts to cause electromagnetic induction heating of the fixing roller 15.

Then, the surface temperature of the fixing roller 15 is detected by the thermistor TH. Electric information relating to the detected temperature output from the thermistor TH is input to the control circuit section B via an A/D converter (not shown). The control circuit section B controls the exciting circuit C so that the temperature of the fixing roller 15 is raised and maintained at a target temperature (fixing temperature) based on the temperature detection information from the thermistor TH. That is, the control circuit section B controls the power supply from the exciting circuit C to the coil 11.

As described above, under a state in which the fixing roller 15 and the pressure roller 16 are rotated and the temperature of the fixing roller 15 reaches the predetermined fixing temperature and is adjusted, the recording material P bearing the unfixed toner image t is introduced to the nip portion N with the image surface side being faced toward the fixing roller 15. The recording material P is brought into close contact with the outer surface of the fixing roller 15 at the nip portion N, and is nipped and conveyed through the nip portion N with the fixing roller 15. With this, heat of the fixing roller 15 and nip pressure are applied to the recording material P, and thus the unfixed toner image t is thermally pressurized to be fixed on the surface of the recording material P as a fixing image. The recording material P exiting from the nip portion N is sequentially separated from the surface of the fixing roller 15 to be discharged and conveyed.

(3) Regarding Second Core Portion 12*a* of Core 12

Figure 4:
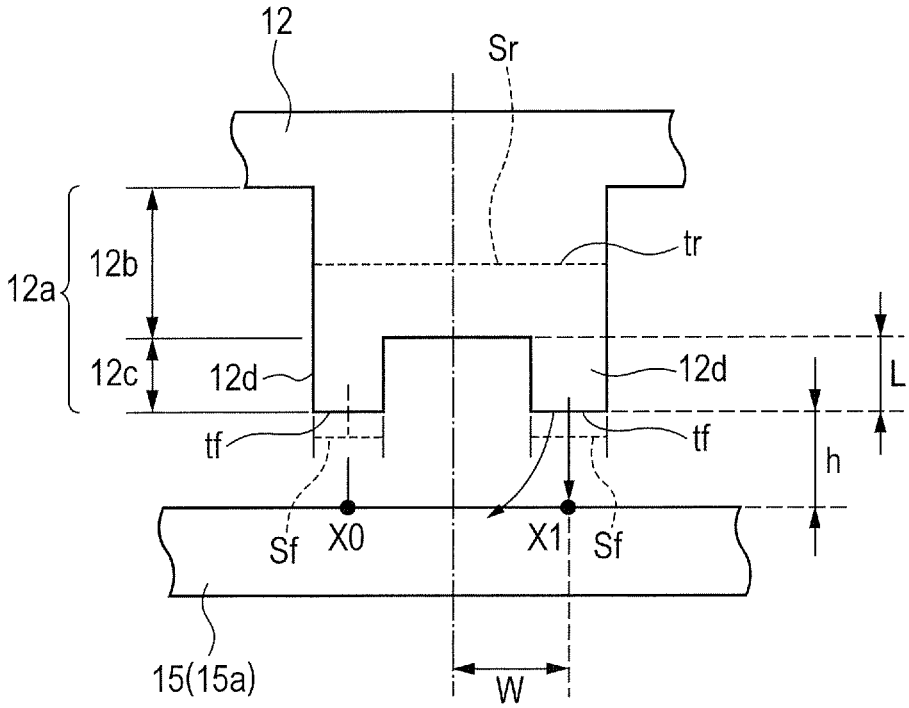
FIG. 4 is a partial enlarged view of FIG. 2.
Figure 5:
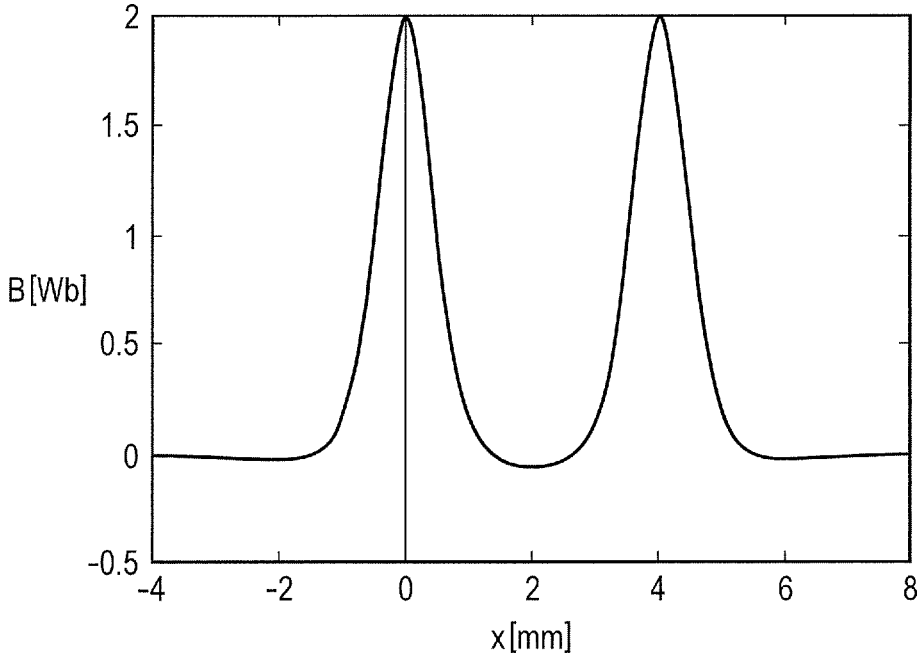
FIG. 5 is a distribution chart of magnetic flux density for explaining the principle of the first embodiment.

FIG. 4 is an enlarged lateral sectional view of a part of the second core portion 12*a* of the core 12 illustrated in FIGS. 2 and 3, the part being inserted into the winding center portion 11*a* of the coil 11 to be opposed to the fixing roller 15. The second core portion 12*a* includes a root portion 12*b* on a base portion side that is the outer core 12*g* side, and a leading end portion 12*c* on a free end portion side that is a side opposed to the fixing roller 15. FIG. 5 is a graph illustrating the density of the magnetic flux at a certain moment, which is oscillated from the leading end portion 12*c* of the second core portion 12*a* of FIG. 4 and is generated on the induction heat generating member 15*a* of the fixing roller 15.

The second core portion 12*a* includes a leading end protruding portion 12*d* on a leading end side (leading end portion 12*c*), which has a width smaller than that of the root portion 12*b*. In this embodiment, the leading end portion 12*c* is branched into two parts in the circumferential direction of the fixing roller 15 to include two leading end protruding portions 12*d*. Of course, there is no intention of limiting the number of the leading end protruding portions 12*d* to two, and three or more leading end protruding portions may be formed.

An area Sf refers to an area of a surface of each leading end protruding portion 12*d*, which is opposed to the fixing roller 15, and a sectional area Sr refers to a sectional area of the root portion 12*b*. A thickness tf refers to a thickness of the surface of each leading end protruding portion 12*d* in the fixing roller circumferential direction, and a thickness tr refers to a thickness of the root portion 12*b* in the fixing roller circumferential direction.

As described later, the area of the surface of the leading end portion 12*c*, which is opposed to the fixing roller 15, is smaller than the sectional area of the root portion 12*b*. The area of the surface of the leading end portion 12*c*, which is opposed to the fixing roller 15, refers to the area of the surface of the leading end portion 12*c*, which is closest to the fixing roller 15, and in this embodiment, refers to a total area of the surfaces of the leading end protruding portions 12*d*. There are two leading end protruding portions 12*d*, and hence the area of the surface of the leading end portion 12*c*, which is opposed to the fixing roller 15, refers to the sum of the areas of the surfaces of the two leading end protruding portions 12*d*.

In other words, in the circumferential direction of the fixing roller 15, the thickness of the surface of the leading end portion 12*c* is smaller than the thickness tr of the root portion 12*b*. The thickness of the surface of the leading end portion 12*c* refers to a thickness of the surface of the leading end portion 12*c*, which is closest to the fixing roller, and in this embodiment, refers to the sum of the thicknesses tf of the surfaces of the leading end protruding portions 12*d*. There are two leading end protruding portions 12*d*, and hence the thickness of the surface of the leading end portion 12*c* refers to the sum (2×tf) of the thicknesses of the surfaces of the two leading end protruding portions 12*d*.

The area Sf and the sectional area Sr satisfy the following relational expressions. The size of the leading end portion 12*c* can be determined in a range that satisfies Expressions (1) and (2) below.

$$Bf=Sr\cdot Br/nSf \qquad \text{Expression (1)}$$

$$nSf<Sr$$

$$Bf<B\max<Bst \qquad \text{Expression (2)}$$

Br: magnetic flux density of root portion 12*b* of second core portion 12*a*

Bf: magnetic flux density of leading end portion 12*c* of second core portion 12*a*

Bmax: maximum magnetic flux density

Bst: saturation magnetic flux density n: number of branches of leading end portion 12*c* (two in this embodiment)

A distance h between the leading end portion 12*c* and the induction heat generating member 15*a* of the fixing roller 15, which is opposed to the leading end portion 12*c*, is set as small as possible in design. As the distance h becomes smaller, the leakage of the magnetic flux that the induction heat generating member 15*a* receives from the leading end portion 12*c* of the second core portion 12*a* reduces, and the magnetic flux density increases. As is understood from Expressions (6) and (7) described in the section of (Heat Generation Mechanism) later, when the magnetic flux density is large, the time change of the magnetic flux on the induction heat generating member 15*a* during the fixing operation increases, and hence the heat generation efficiency improves.

In a case where the leading end portion 12*c* of the second core portion 12*a* is branched into multiple parts in the circumferential direction of the fixing roller 15 to include multiple leading end protruding portions 12*d*, those leading end protruding portions 12*d* can be arranged as follows. That is, the leading end protruding portions 12*d* can be arranged so as to maintain an interval that prevents the magnetic fluxes generated from the leading ends of the respective leading end protruding portions 12*d* from interfering with each other in the induction heat generating member 15*a*.

In other words, a relationship of leading end protruding portions 12*d* illustrated in FIG. 4 can be set to such a distance that the magnetic flux between the peaks of the magnetic flux density in the graph of FIG. 5 becomes exactly zero. A reference mark w represents the half of a center-to-center distance between the leading end protruding portions 12*d* adjoining mutually. At this time, the magnetic fluxes in the induction heat generating member 15*a* of the fixing roller 15 do not interfere with each other to have a maximum level, and hence the heat generation efficiency can be improved. The graph of FIG. 5 can be obtained through electromagnetic field simulation, experiments, and the like. The term "interfere" herein refers to the case where the magnetic flux between the peaks of the magnetic flux density does not become zero. In contrast, the phrase "not interfere" herein refers to the case where the magnetic flux between the peaks of the magnetic flux density becomes zero.

A height L of the leading end protruding portions 12*d* can be set to such a length that, as described in the section of (Magnetic Flux Splitting Mechanism) below with reference to Expressions (4) and (5), the magnetic flux passing through an air layer of the leading end portion 12*c* becomes negligibly small when compared with the magnetic flux passing in the leading end protruding portions 12*d*.

Substantially, when the structure of the leading end portion 12*c* of the second core portion 12*a* is determined so as to satisfy Expressions (1) and (2) for the fixing device F for use in the image forming apparatus such as a printer, a copying machine, and a facsimile machine, the height L may be set to a length of several millimeters. That is, with this setting, the magnetic resistance of the air layer becomes significantly large when compared with the magnetic resistance inside the leading end protruding portions 12*d*, and the magnetic flux passing through the air layer becomes negligibly small.

Magnetic Flux Splitting Mechanism

Figure 6A:
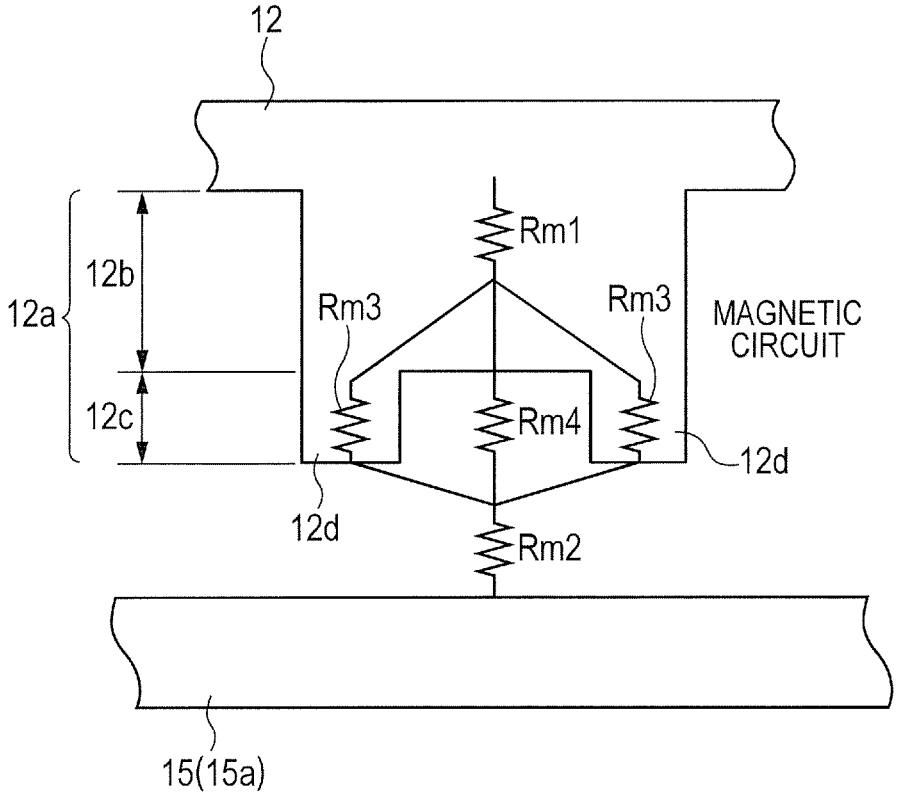
FIGS. 6A and 6B are schematic diagrams of a magnetic circuit at a convex-shaped part.
Figure 6B:
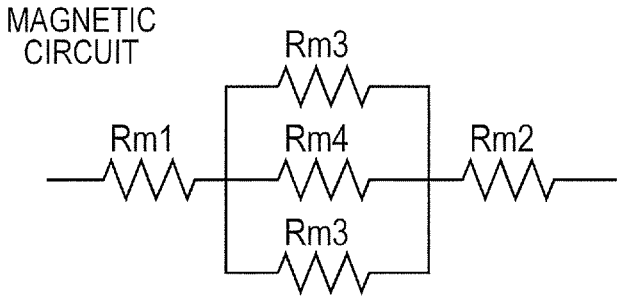

With reference to FIGS. 6A and 6B, description is made of a principle that the magnetic flux passing inside the root portion 12*b* of the convex-shaped part 12*a* is split and concentrated at the leading end portion 12*c* including the leading end protruding portions 12*d*. The magnetic flux has the following relationship:

$$V=\phi R$$

where R represents a magnetic resistance, V represents a magnetomotive force, and ϕ represents a magnetic flux. This relationship corresponds to the Ohm's law in electrical circuits. Therefore, a magnetic circuit equivalent to the electrical circuit may be considered. FIGS. 6A and 6B are respectively a schematic diagram and an equivalent circuit of the magnetic circuit of the convex-shaped part 12*a*. When a magnetomotive force Vm is applied to the leading end portion 12*c* of the convex-shaped part 12*a*, the following relationships may be established among the magnetic resistance, the magnetomotive force, and the magnetic flux:

$$Vm=\phi(Rm1+Rm2+R_G);$$

$$R_G=Rm3=\phi Rm4/(Rm3+2Rm4);$$

$$V_G=\phi R_G;$$

$$\phi_3=V_G/Rm3=\phi Rm4/(Rm3+2Rm4); \text{ and}$$

$$\phi_4=V_G/Rm4=\phi Rm3/(Rm3+2Rm4),$$

where $V_G$ represents a magnetomotive force of the leading end portion 12*c*, $R_G$ represents a magnetic resistance, $\phi_3$ represents a magnetic flux flowing through a magnetic resistance Rm3, and $\phi_4$ represents a magnetic flux flowing through a magnetic resistance Rm4.

There are two passages for the magnetic resistance Rm3. Further, the magnetic flux $\phi$ in the root portion 12*b* of the second core portion 12*a* satisfies the following relationship.

$$2\phi_3+\phi_4=\phi$$

Therefore, the ratio between the magnetic flux passing through the passages of the magnetic resistance Rm3 and the magnetic flux passing through the passage of the magnetic resistance Rm4 is as follows.

$$\phi_4/2\phi_3=Rm3/2Rm4 \qquad \text{Expression (3)}$$

At this time, the relationships among the shape of the leading end portion 12*c* and the magnetic resistances Rm3 and Rm4 are as follows.

$$Rm3=L/(Sf\cdot\mu m) \qquad \text{Expression (4)}$$

$$Rm4=L/\{(Sr-2Sf)\mu 0\} \qquad \text{Expression (5)}$$

$\mu 0$: magnetic permeability in air (vacuum)
$\mu m$: magnetic permeability of core For example, in a case of Sf=10 [$mm^2$], Sr=50 [$mm^2$], $\mu 0=4\pi\times10^{-7}$, and $\mu m$=1,000, the ratio between the magnetic flux $2\phi_3$ passing though the leading end portion 12*c* and the magnetic flux $\phi_4$ passing through the air layer is as follows.

$$\phi_4/2\phi_3=(Sr-2Sf)/2Sf\cdot\mu 0m=1.9\times10^{-9}$$

Therefore, the magnetic flux passing through the air layer is ignorable. The shape of the leading end portion 12*c* satisfies Expressions (1) and (2), and be used in a range that the maximum magnetic flux density does not exceed the saturation magnetic flux density. That is, the thickness (sectional area) of the surface of the leading end portion 12*c* is set so that the maximum magnetic flux density at the surface of the leading end portion 12*c* does not exceed the saturation magnetic flux density thereof.

Heat Generation Mechanism

The coil 11 generates an alternating magnetic flux by an alternating current supplied from the exciting circuit C, and the alternating magnetic flux is guided by the cores 12, 13, and 14 to generate an eddy current in the base member 15*a* as the induction heat generating member of the fixing roller 15. With the eddy current, the induction heat generating member generates Joule heat by its specific resistance. That is, the alternating current is supplied to the coil 11, and thus the fixing roller 15 is set to an electromagnetic induction heating state. Heat generation in electromagnetic induction is a Joule loss of the eddy current. An eddy current loss P is represented by Expression (6) below.

$$P=k(t\cdot f\cdot B\max)^2/\rho \qquad \text{Expression (6)}$$

P: eddy current Joule loss
k: proportionality constant
t: thickness of induction heat generating member
f: frequency
Bmax: maximum magnetic flux density
$\rho$: resistivity of induction heat generating member Further, an electromotive force E for generating the eddy current obeys Expression (7) below.

$$E=-\partial\phi/\partial t=-S\partial B/\partial t\propto i \qquad \text{Expression (7)}$$

E: electromotive force of eddy current
$\phi$: magnetic flux in region generating eddy current
B: magnetic flux density
t: time
i: eddy current In accordance with Expression (7) above, the amount of heat generation can be increased by increasing the maximum magnetic flux density to be applied to the heat generating portion of the induction heat generating member 15*a*.

The basic configuration and the principle have been described above. Next, an example is described in which the above-mentioned core structure (structure of the second core portion 12*a* of the core 12) is used in a specific device. In a conventional IH fixing device which operates at a frequency of 20 kHz and more and uses a total power of 1,400 W, it is known that 90% of the total power of 1,400 W is input to the coil, and 90% to 95% of the power input to the coil is used for heat generation. Therefore, 81% to 85.5% of the total power is used for heat generation.

A case of adopting the above-mentioned core structure to the conventional fixing device under the following conditions is considered. The fixing device uses the core 12 having the saturation magnetic flux density of 500 mT or more, a magnetic field oscillating frequency is 20 kHz or more, and the fixing device drives the fixing roller 15 of $\phi$30 at 310 rpm. In this fixing device, the distance h between the leading end portion 12*c* of the second core portion 12*a* and the fixing roller 15 is set to 4 mm. The total area 2Sf of the surface of the leading end portion 12*c* is set to half of the total area in the conventional case (2Sf/Sr=½). The center-to-center distance between the leading end protruding portions 12*d* adjoining mutually is set to 7.5 mm.

Figure 7:
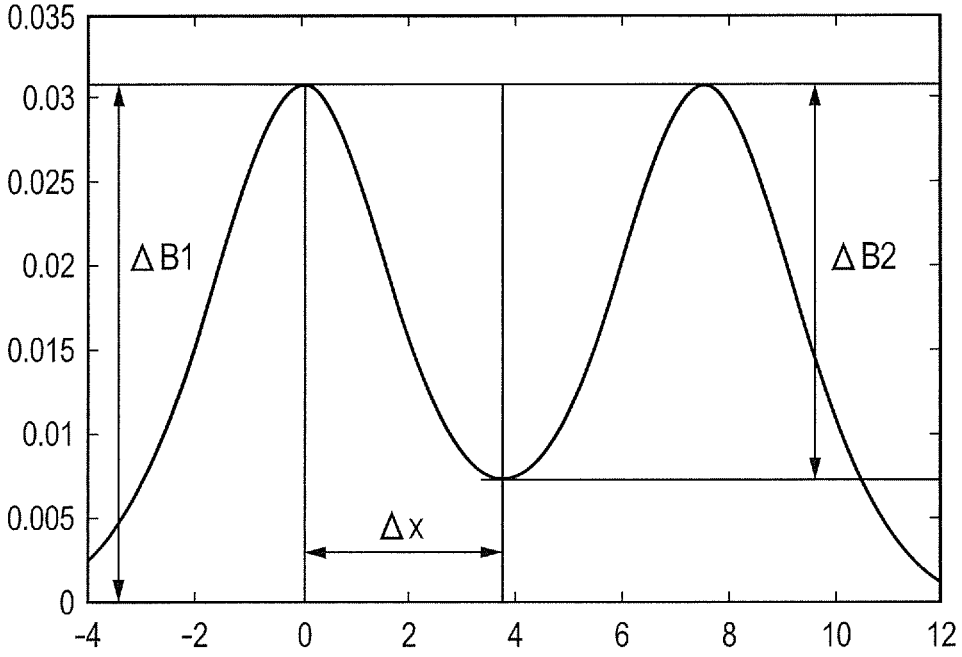
FIG. 7 is a distribution chart of magnetic flux density on a fixing roller.

In such a device, the magnetic flux density at a certain moment on the fixing roller surface immediately below the leading end portion of the second core portion 12*a* is as shown in the graph of FIG. 7.

The magnetic field oscillating frequency is 20 kHz, and the moving speed of the surface of the fixing roller 15 is 500 mm/s. Therefore, one period is extremely short relative to the time interval of the moving speed of the surface of the fixing roller 15, and hence it can be deemed that the magnetic flux is present almost constantly with respect to the moving speed of the fixing roller 15. Therefore, when a certain point on the fixing roller 15 is focused, an eddy current proportional to the magnetic field gradient of FIG. 7 and the moving speed of the fixing roller is generated. Expression (8) represents this relationship.

$$dB/dt\approx\Delta B\cdot v/\Delta x \qquad \text{Expression (8)}$$

The fixing roller 15 moves in the x direction of the graph of FIG. 7. There are two peaks in the magnetic flux density, and hence the eddy current generation amount is represented by Expression (9) below.

$$2(\Delta B1/\Delta x+\Delta B2/\Delta x)v \quad \text{Expression (9)}$$

Referring to Expression (9) and the graph of FIG. 7, when the core having the above-mentioned configuration is applied to the conventional fixing device, an improvement in heat generation efficiency of 6.4% is estimated.

Figure 8A:
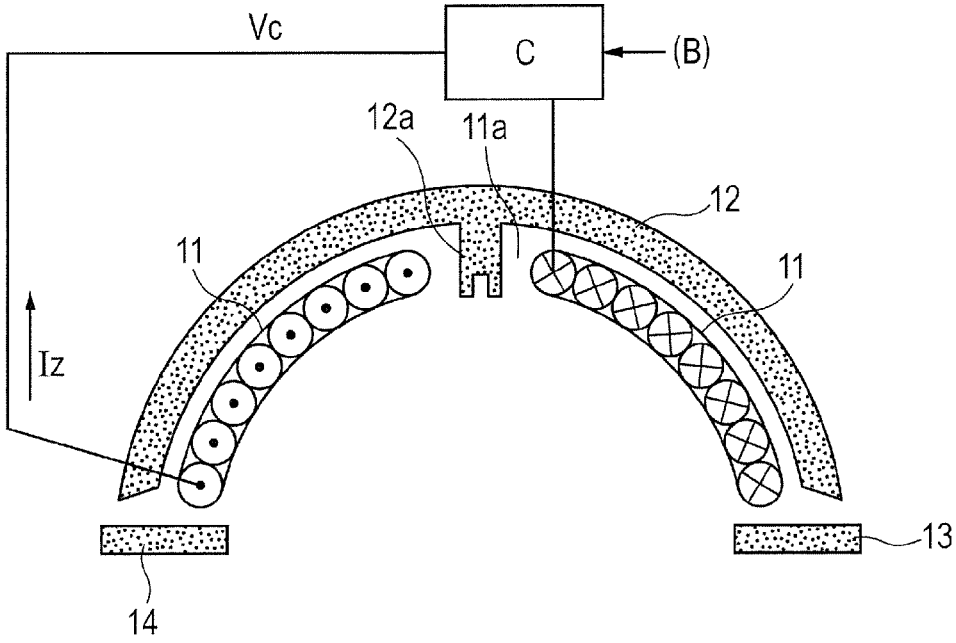
FIGS. 8A and 8B illustrate a method of confirming the heat generation efficiency.
Figure 8B:
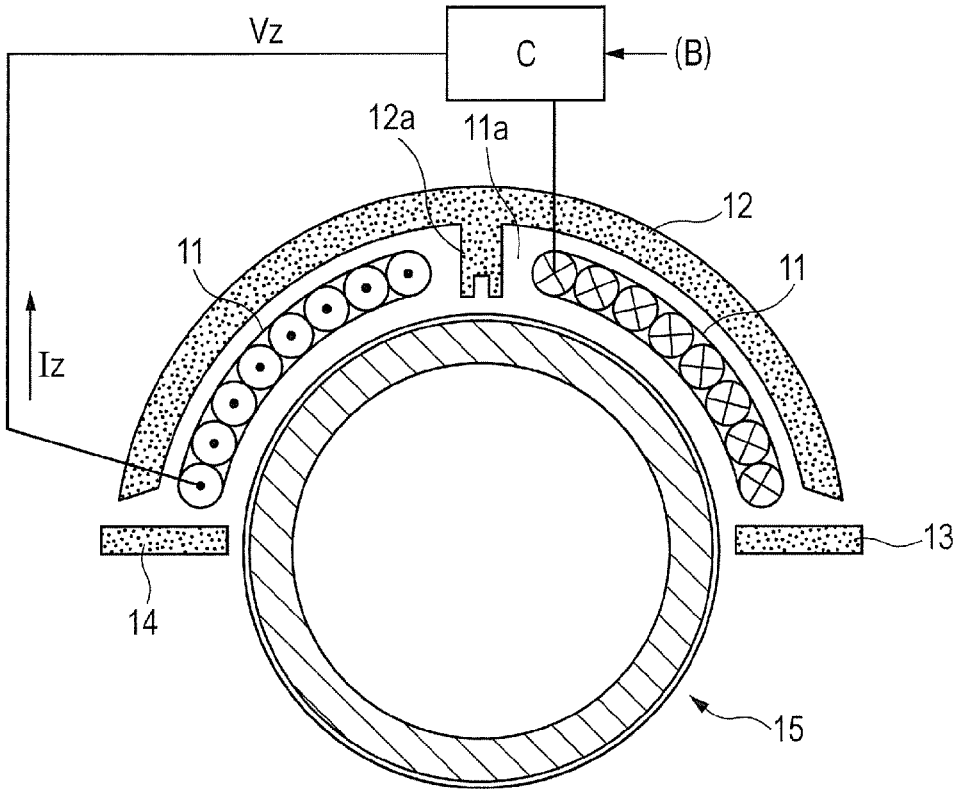
Figure 9A:
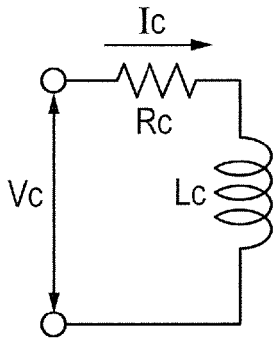
FIGS. 9A, 9B, and 9C illustrate electric circuits of exciting units illustrated in FIGS. 8A and 8B.
Figure 9B:
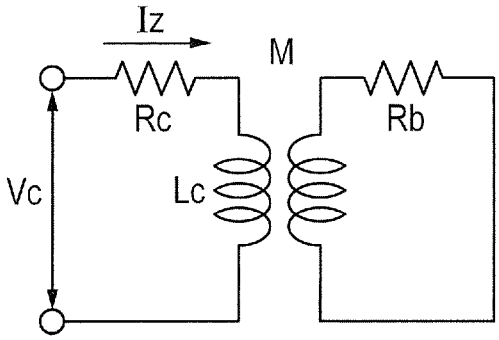
Figure 9C:
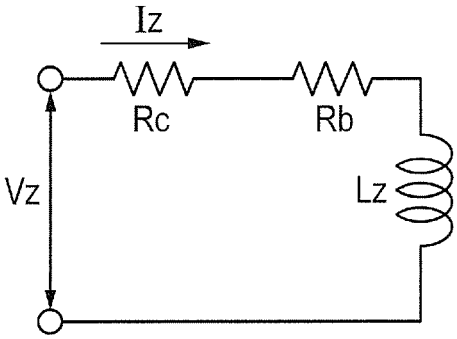

The improvement in heat generation efficiency can be confirmed by a heat generation efficiency confirming experiment illustrated in FIGS. 8A and 8B and FIGS. 9A, 9B, and 9C. FIG. 8A illustrates the states of merely the coil 11 and the cores 12 to 14 under a state in which the fixing roller 15 is removed. FIG. 8B illustrates a state in which a magnetic circuit is formed by the coil 11, the cores 12 to 14, and the fixing roller 15. The electric circuit representing the state of FIG. 8A is illustrated in FIG. 9A, and the electric circuit representing the state of FIG. 8B is illustrated in FIG. 9B. FIG. 9C illustrates an equivalent circuit of FIG. 9B.

When a constant voltage Vc is applied to the coil in the configuration illustrated in FIG. 8A, a resistance Rc can be determined from a current Ic flowing therethrough. Next, under a state in which the fixing roller 15 in the configuration illustrated in FIG. 8B is rotated at a speed v of 500 mm/s, a constant voltage Vz is applied to the coil 11, and a resistance is determined from a current Iz flowing therethrough. With this, it is possible to determine a combined resistance (Rc+Rb) represented by the sum of the resistance Rc of the coil 11 and the resistance Rb when the leading end portion 12*c* and the fixing roller 15 are included. At this time, the heat generation efficiency of the fixing roller 15 can be determined as follows.

$$(1-Rc/(Rc+Rb))\times 100 \quad \text{Expression (10)}$$

Figure 10:
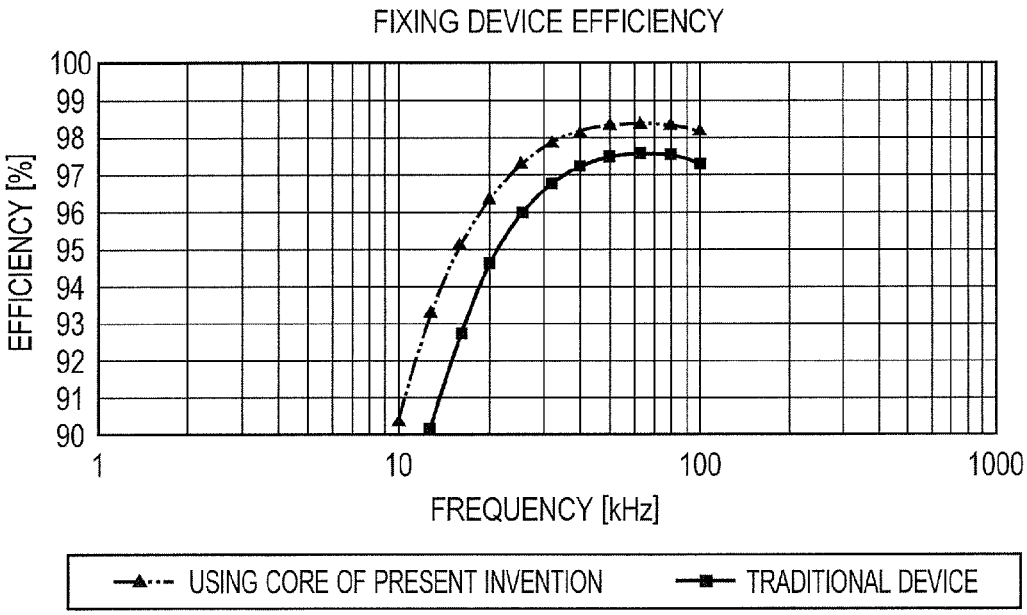
FIG. 10 is a graph showing results of the heat generation efficiency confirming experiment illustrated in FIGS. 8A and 8B.

FIG. 10 is a graph comparing the heat generation efficiency determined as described above between the traditional device and the first embodiment. This graph shows an improvement of 1.8%. Therefore, when the core configuration according to the first embodiment is used in the traditional machine, the heat generation efficiency of the entire fixing device with respect to the total power can be improved up to 82.6% to 87.1%, which has been 81% to 85.5% in the conventional case.

Figure 11:
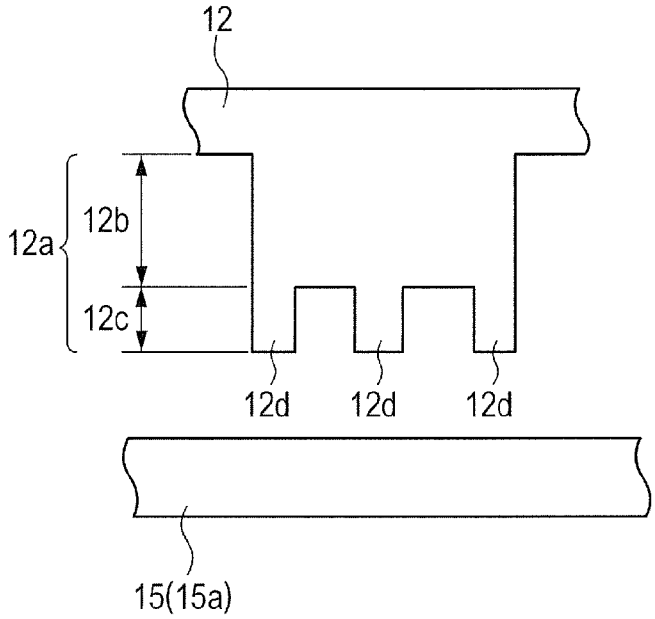
FIG. 11 is a schematic view of an example in which three leading end protruding portions are provided to a leading end portion of the convex-shaped part.

In the above-mentioned example, the leading end portion 12*c* of the second core portion 12*a* is branched into two parts in the circumferential direction of the fixing roller 15 to include two leading end protruding portions 12*d*, but the present invention is not limited thereto. The leading end portion 12*c* may be branched into multiple parts of two or more in the circumferential direction of the fixing roller 15 to include multiple leading end protruding portions 12*d* of two or more. FIG. 11 illustrates an example in which three leading end protruding portions 12*d* are included.

Figure 12:
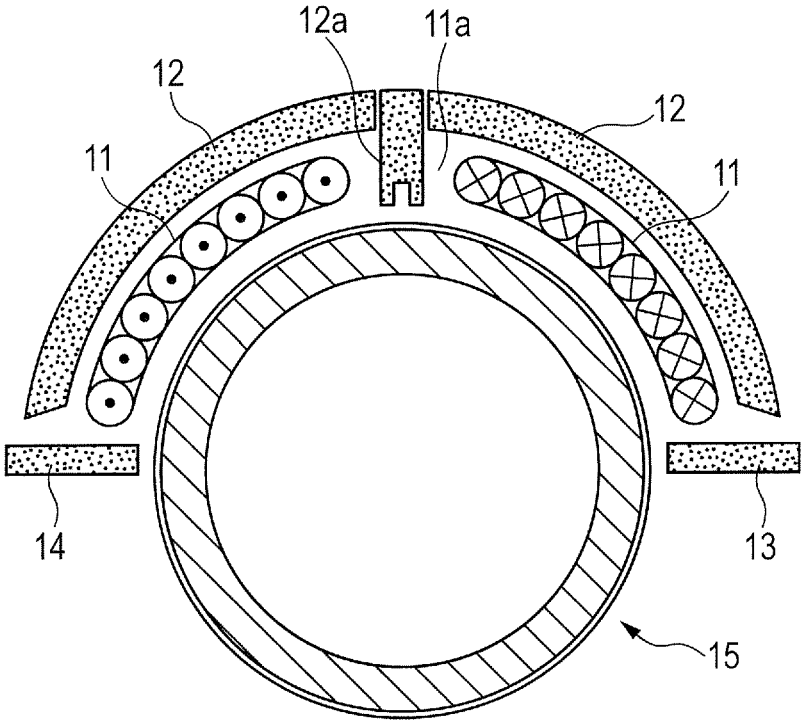
FIG. 12 is a schematic view of a modified example of the main core.

In the core 12, the part surrounding the outer periphery of the coil 11 and the part of the second core portion 12*a* to be inserted into the winding center portion 11*a* of the coil 11 may not be integrally formed. As illustrated in FIG. 12, the part surrounding the outer periphery of the coil 11 and the part of the second core portion 12*a* to be inserted into the winding center portion 11*a* of the coil 11 may be separately formed.

In this embodiment, the sub-cores 13 and 14 do not have the same configuration as the second core portion of the core 12. However, there is no intention of limiting to this configuration. Also the cores 13 and 14 as the sub-cores may have the same configuration as the second core portion 12*a* of the core 12. The cores 13 and 14 as the sub-cores may be omitted in the device configuration.

Second Embodiment

Figure 13:
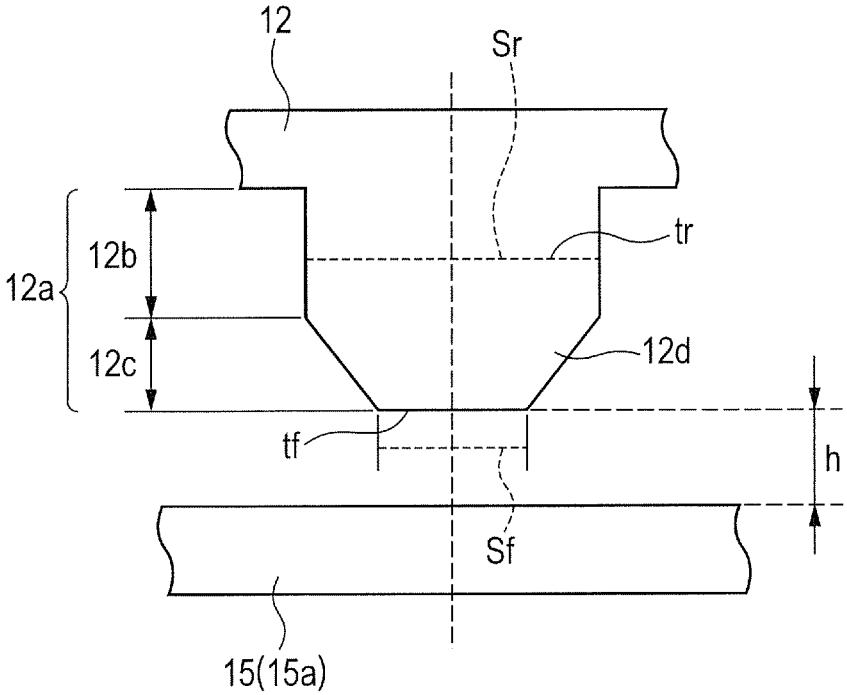
FIG. 13 is an enlarged lateral sectional view of a convex-shaped part of a main core according to a second embodiment.
Figure 14:
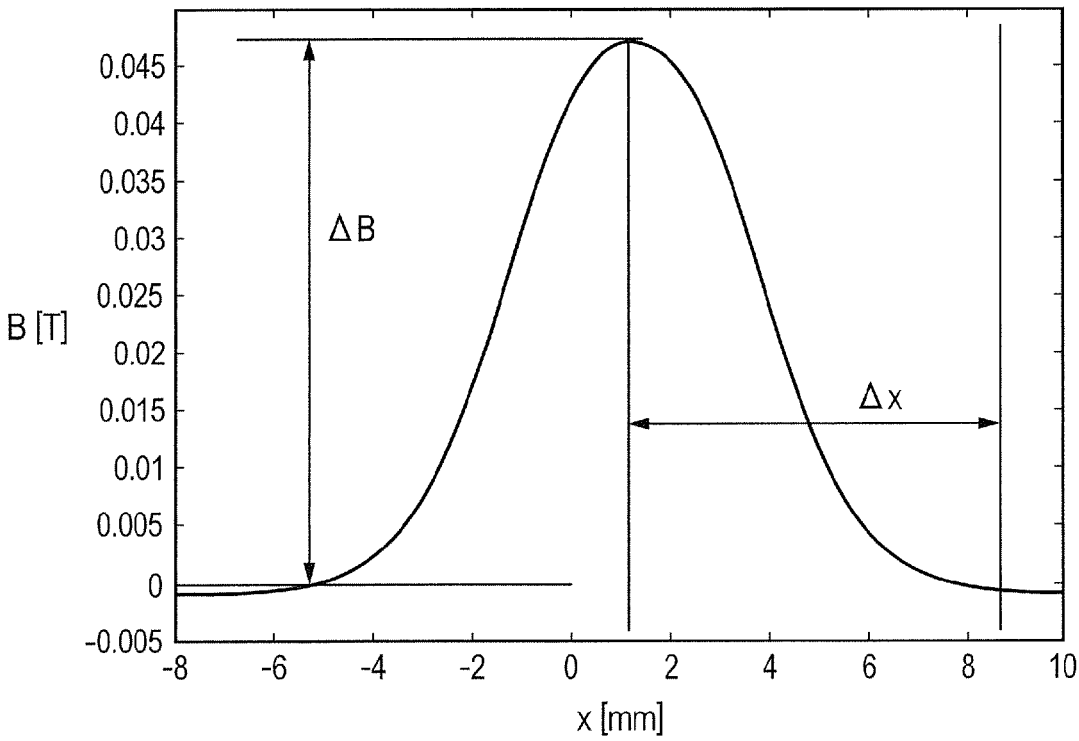
FIG. 14 is a distribution chart of magnetic flux density on a fixing roller of the second embodiment.

With reference to FIGS. 13 and 14, a second embodiment of the present invention is described. The configuration and the principle of the second embodiment are the same as those of the first embodiment except for the configuration of the core 12.

Magnetic Core

FIG. 13 is an enlarged lateral sectional view of a part of the second core portion 12*a* of the core 12. In this embodiment, the leading end portion 12*c* of the second core portion 12*a* of the core 12 is shaped so as to be narrowed to have a mountain shape (tapered shape) toward the fixing roller 15 in its lateral cross-section. With this, on the leading end side of the second core portion 12*a*, there is provided one leading end protruding portion 12*d* having a width smaller than the width of the root portion 12*b* of the second core portion 12*a* in the fixing roller circumferential direction. The area Sf of the surface of the leading end protruding portion 12*d*, which is opposed to the fixing roller 15, and the sectional area Sr of the root portion 12*b* of the second core portion 12*a* may be determined so as to satisfy Expressions (1) and (2) similarly to the first embodiment.

The distance h between the leading end portion 12*c* (leading end protruding portion 12*d*) and the fixing roller 15 may be reduced as much as possible in design. As the distance h becomes smaller, the leakage of the magnetic flux that the heat generating portion of the fixing roller 15 receives from the leading end portion 12*c* reduces, and the magnetic flux density increases. As is understood from Expressions (6) and (7) described in the first embodiment, when the magnetic flux density is large, the time change of the magnetic flux on the heat generating portion during the fixing operation increases, and hence the heat generation efficiency improves.

Even when the leading end portion 12*c* is not branched and the area of the leading end portion is small, the magnetic flux at the root of the second core portion 12*a* concentrates at the leading end portion 12*c*, and hence it is possible to obtain the effect of improving the heat generation efficiency. The second embodiment differs from the first embodiment in that the leading end portion 12*c* is not branched into two parts, and hence the second core portion 12*a* can be downsized.

Note that, as compared to the first embodiment, the eddy current generation amount on the heat generating member is smaller in the second embodiment, and hence the heat generation efficiency of the second embodiment is smaller than that of the first embodiment. Therefore, the second embodiment is suited for a case where the first embodiment cannot be applied and downsizing of the fixing roller 15 is required.

In the following, an example is described in which the core 12 of the second embodiment is applied to the conventional fixing device which operates at the frequency of 20 kHz or more, has a total power of 1,400 W, and uses 81% to 85.5% of the total power for heat generation.

The fixing device uses the core 12 having the saturation magnetic flux density of 500 mT or more, a magnetic field oscillating frequency is 20 kHz or more, and the fixing device drives the fixing roller 15 of ϕ30 at 310 rpm. The distance h between the leading end portion 12*c* of the second core portion 12*a* and the fixing roller 15 is set to 4 mm, and the total area Sf of the surface of the leading end portion 12*c* is set to half of the total area in the conventional case (Sf/Sr=½). In such a device, the magnetic flux density at a certain moment on the fixing roller surface immediately below the leading end portion 12*c* is as shown in the graph of FIG. 14.

The magnetic field oscillating frequency is 20 kHz, and the moving speed of the surface of the fixing roller 15 is 500 mm/s. Therefore, one period is extremely short relative to the time interval of the moving speed of the surface of the fixing roller 15, and hence it can be deemed that the magnetic flux is present almost constantly with respect to the moving speed of the fixing roller 15. Therefore, when a certain point on the fixing roller 15 is focused, an eddy current proportional to the magnetic field gradient of FIG. 14 and the moving speed of the fixing roller is generated. The eddy current at this time obeys Expression (8) similarly to the case of the first embodiment.

In the second embodiment, the leading end portion 12*c* of the second core portion 12*a* is not branched, and hence the number of peaks of the magnetic flux density is only one as shown in FIG. 14. Therefore, the eddy current amount generated while the fixing roller 15 passes through the peak of the magnetic flux is proportional to the following expression.

$$2\Delta B \cdot v/\Delta x \qquad \text{Expression (11)}$$

Referring to Expression (11) and the graph of FIG. 14, when the core 12 of the second embodiment is applied to the conventional fixing device, an improvement in heat generation efficiency of 1.6% is estimated. Further, the heat generation efficiency can be determined by a method similar to the case of the first embodiment with a device in which the shape of the leading end portion 12*c* of the second core portion 12*a* illustrated in FIGS. 8A and 8B is changed to the shape illustrated in FIG. 13.

Third Embodiment

Figure 15:
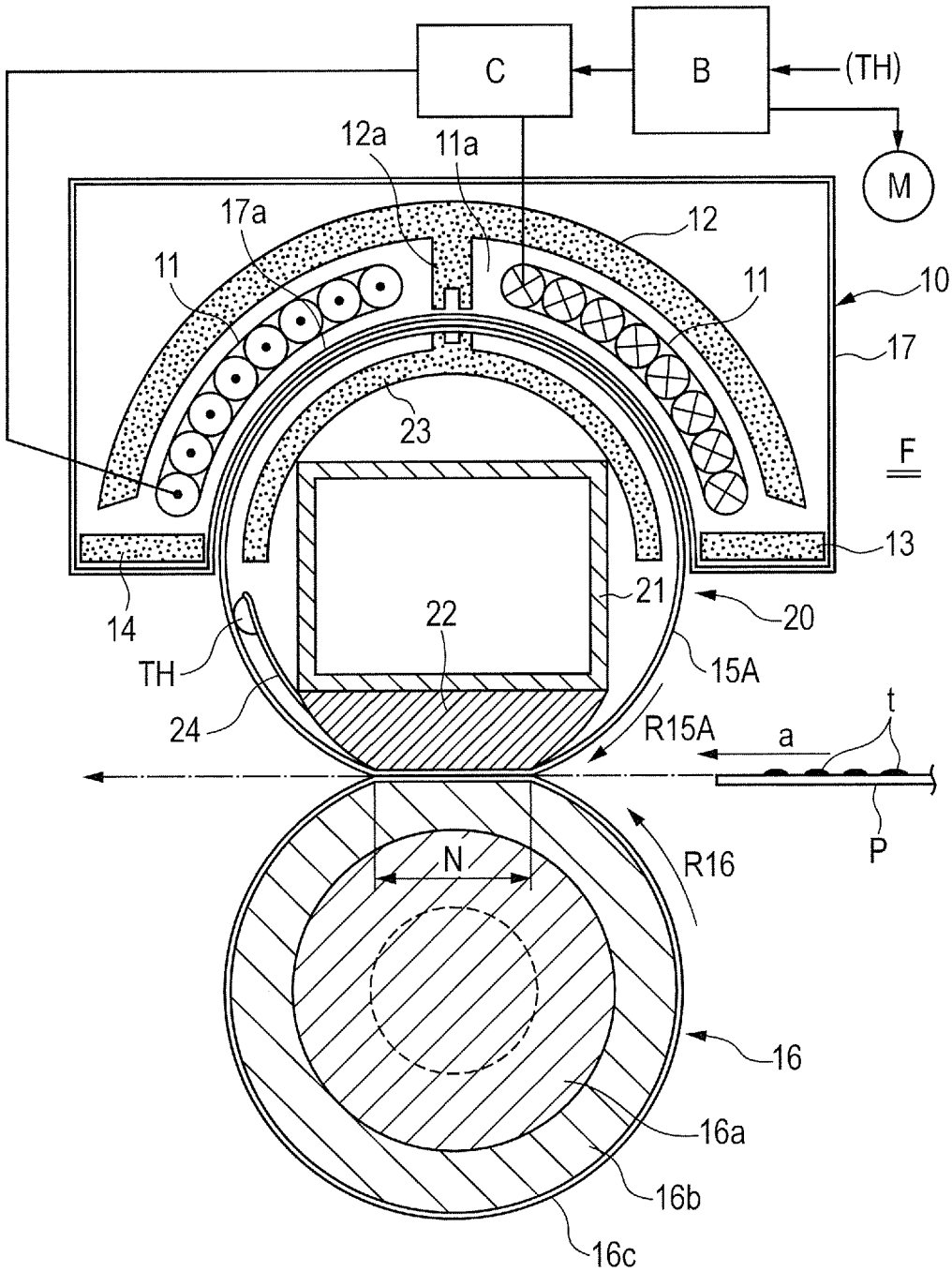
FIG. 15 is a schematic lateral sectional view of a main part of a fixing device according to a third embodiment.
Figure 16:
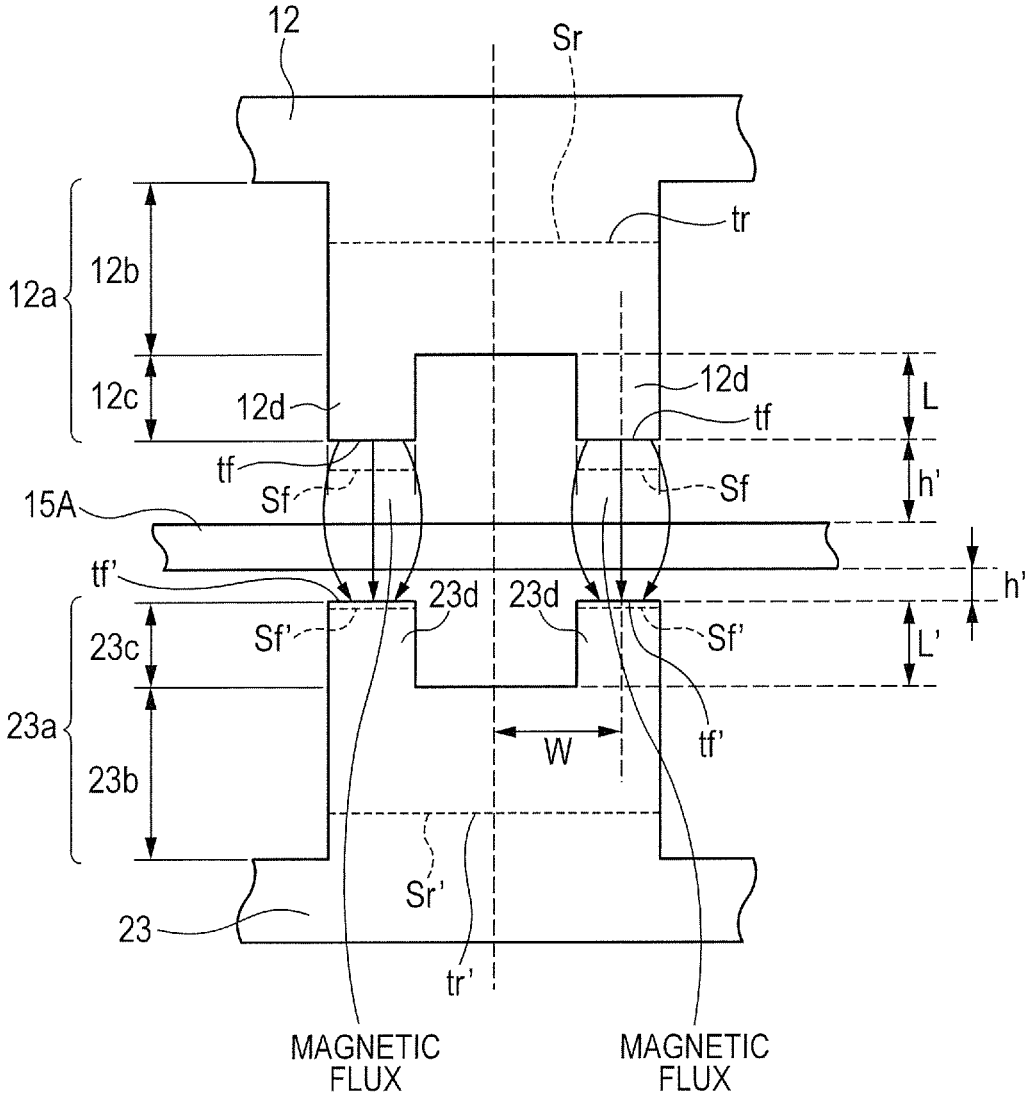
FIG. 16 is a partial enlarged view of FIG. 15.
Figure 17:
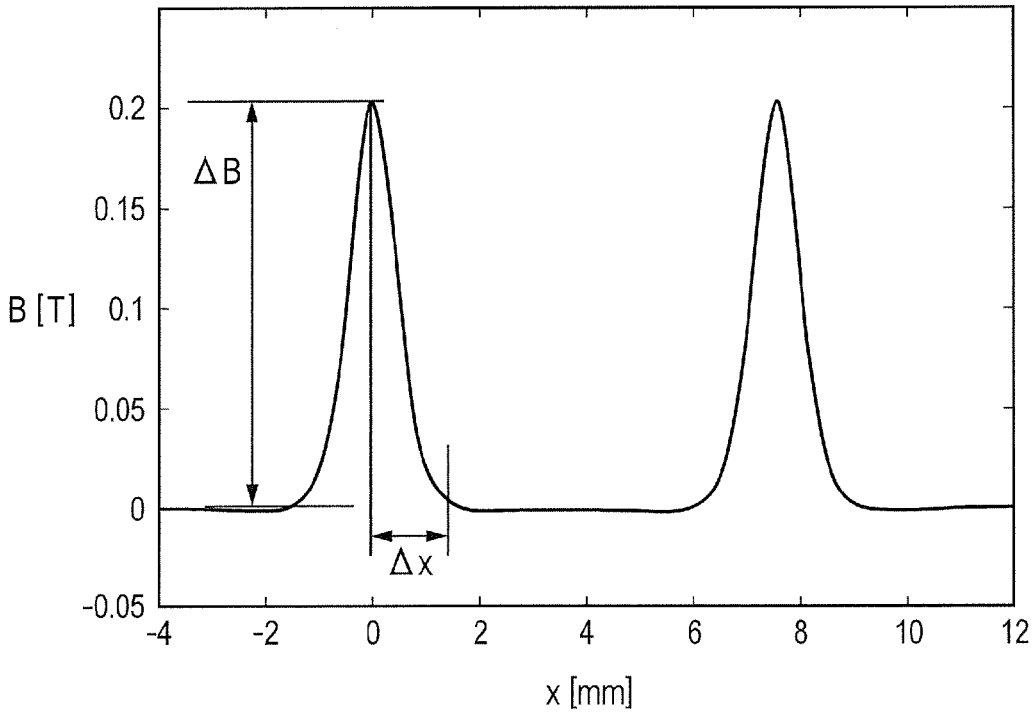
FIG. 17 is a distribution chart of magnetic flux density on a fixing belt of the third embodiment.

Referring to FIGS. 15 to 17, a third embodiment of the present invention is described. FIG. 15 is a schematic enlarged view for illustrating a right side of a main part of an IH-ODF fixing device F according to the third embodiment in lateral cross-section. In the IH-ODF fixing device, as the rotatable heating rotary member, not the fixing roller 15 according to the first and second embodiments but a thin fixing belt 15A having flexibility is used. Thus, the heat capacity of the heating member is reduced, and the rising performance of the temperature increase is improved.

In FIG. 15, below and above a fixing belt unit 20, the pressure roller 16 and the heating assembly 10 as the magnetic flux generating unit are arranged, respectively. The pressure roller 16 and the heating assembly 10 are similar to those of the fixing device of the first embodiment.

The unit 20 includes the rotatable and cylindrical fixing belt 15A as the heating rotary member which is formed of a magnetic member (metal layer or conductive member) which generates heat by electromagnetic induction. The unit 20 further includes a metallic stay 21 inserted inside the belt 15A. On the lower surface of the stay 21, a pressure pad 22 as a pressure applying member is fixed along the longitudinal direction of the stay. On the upper surface side of the stay 21, a magnetic core (hereinafter referred to as inside core) 23 is arranged along the longitudinal direction of the stay 21.

The stay 21 needs to have rigidity for applying pressure to the nip portion N, and hence is made of iron in this embodiment. The pad 22 is a member that forms the fixing nip portion N by causing a pressing force to act between the belt 15A and the pressure roller 16, and is made of a heat resistant resin. The belt 15A is loosely fitted over an assembly of the above-mentioned stay 21, pad 22, and inside core 23. At a longitudinal center portion of the pad 22, the thermistor TH as the temperature detecting unit of the belt 15A is arranged through intermediation of an elastic support member 24. The thermistor TH elastically abuts against the inner surface of the belt 15A by the elasticity of the member 24.

The belt 15A includes, as a base member, a thin and cylindrical metal layer formed of a ferromagnetic member which is the induction heat generating member, and entirely has low heat capacity and flexibility (elasticity). The belt 15A maintains the cylindrical shape in a free state. A metal such as iron, nickel, an iron alloy, copper, and silver may be appropriately selected as the material thereof. Another functional layer such as a release layer and an elastic layer may be additionally provided as appropriate to this metal layer.

The pad 22 of the unit 20 and the pressure roller 16 are brought into pressure contact with each other across the belt 15A at a predetermined pressing force. Between the belt 15A and the pressure roller 16, the nip portion (fixing nip portion) N of a predetermined width is formed in the recording material conveyance direction "a".

In this device, the pressure roller 16 is driven to rotate in a counterclockwise direction of the arrow R16. With this, a rotational force acts on the belt 15A by the frictional force between the surface of the pressure roller 16 and the surface of the belt 15A at the nip portion N. The belt 15A is caused to rotate under a state in which the inner surface thereof slides while being held in close contact with the lower surface of the pad 22 around the stay 21, the pad 22, and the inside core 23 in the clockwise direction of an arrow R15A at the same rotational speed as the pressure roller 16.

The coil 11 of the heating assembly 10 generates the alternating magnetic flux in response to the supply of the alternating current. The alternating magnetic flux is guided to the metal layer of the belt 15A on the upper surface side of the rotating belt 15A. Then, the eddy current is generated in the metal layer, and the Joule heat caused by the eddy current causes temperature rise of the belt 15A. The temperature of the belt 15A is detected by the thermistor TH and is fed back to the control circuit section B. The control circuit section B controls the power to be supplied from the exciting circuit C to the coil 11 so that the detected temperature input from the thermistor TH is maintained at a predetermined target temperature (fixing temperature).

Under this state, the recording material P bearing the unfixed toner image t is introduced into the nip portion N. The recording material P is brought into close contact with the outer peripheral surface of the belt 15A at the nip portion N, and is nipped and conveyed at the nip portion N with the belt 15A. With this, the unfixed toner image t is fixed by heat and pressure onto the surface of the recording material P. The recording material P that has passed through the nip portion N is self-separated (curvature-separated) from the outer peripheral surface of the belt 15A due to the deformation of the surface of the belt 15A at its exit part of the nip portion N to be conveyed outside the fixing device.

In the heating assembly 10, the second core portion 12*a* of the outside core 12 arranged outside the belt is similar to that of the first embodiment. That is, as illustrated in FIG. 16, the leading end portion 12*c* branches into two parts in the circumferential direction of the belt 15A to include two leading end protruding portions 12*d*.

The inside core 23 arranged inside the belt is a member having a substantially semi-circular arc shape in lateral cross-section, of which the right-left direction is the longitudinal direction. Further, the inside core 23 is arranged inside the belt 15A to be supported by the stay 21 as a holder. The inside core 23 is opposed to the heating assembly 10 arranged outside the belt 15A while covering a substantially upper half portion of the belt 15A, and is opposed to the substantially upper half portion of the belt 15A in a circumferential direction and a width direction of the belt 15A.

The inside core 23 includes a convex-shaped part 23*a* protruded toward the belt 15A at a position opposed to the second core portion 12*a* of the outside core 12 on the heating assembly 10 side. In this case, the convex-shaped part 23*a* of the inside core 23 includes a root portion 23*b* on a base portion side that is the core 23 side, and a leading end portion 23*c* on a free end portion side that is a side opposed to the belt 15A. A width refers to a dimension of the belt 15A in the circumferential direction.

Similarly to the second core portion 12*a* of the outside core 12, the convex-shaped part 23*a* of the inside core 23 includes a leading end protruding portion 23*d* on the leading end side (leading end portion 23*c*), which has a width smaller than the width of the root portion 23*b*. In this embodiment, the leading end portion 23*c* of the convex-shaped part 23*a* is branched into two parts in the circumferential direction of the belt 15A to include two leading end protruding portions 23*d*. The leading end protruding portion 12*d* of the outside core 12 and the leading end protruding portion 23*d* of the inside core 23 can be coaxially opposed to each other.

An area Sf' refers to an area of a surface of each leading end protruding portion 23*d*, which is opposed to the belt 15A, and an area Sr' refers to a sectional area of the root portion 23*b*. A thickness tf' refers to a thickness of the surface of each leading end protruding portion 23*d* in the circumferential direction of the belt 15A, and a thickness tr' refers to a thickness of the root portion 23*b* in the circumferential direction of the belt 15A.

The area of the surface of the leading end portion 23*c*, which is opposed to the belt 15A, is smaller than the sectional area of the root portion 23*b*. The area of the surface of the leading end portion 23*c*, which is opposed to the belt 15A, refers to the area of the surface of the leading end portion 23*c*, which is closest to the belt 15A, and in this embodiment, refers to a total area of the surfaces of the leading end protruding portions 23*d*. There are two leading end protruding portions 23*d*, and hence the area of the surface of the leading end portion 23*c*, which is opposed to the belt 15A, refers to the sum of the areas of the surfaces of the two leading end protruding portions 23*d*.

In other words, in the circumferential direction of the belt 15A, the thickness of the surface of the leading end portion 23*c* is smaller than the thickness of the root portion 23*b*. The thickness of the surface of the leading end portion 23*c* refers to a thickness of the surface of the leading end portion 23*c*, which is closest to the belt 15A, and in this embodiment, refers to the sum of the thicknesses of the surfaces of the leading end protruding portions 23*d*. There are two leading end protruding portions 23*d* in this embodiment, and hence the thickness of the surface of the leading end portion 23*c*, which is closest to the belt 15A, refers to the sum of the thicknesses of the surfaces of the two leading end protruding portions 23*d*.

A distance h' between the leading end portion 23*c* of the inside core 23 and the belt 15A opposed to the leading end portion 23*c* can be set as small as possible in design. As the distance h' becomes smaller, the leakage of the magnetic flux that the heat generating portion of the belt 15A receives from the leading end portion 23*c* of the inside core 23 reduces, and the magnetic flux density increases.

As is understood from Expressions (6) and (7) described in the section of (Heat Generation Mechanism) in the first embodiment, when the magnetic flux density is large, the time change of the magnetic flux on the heat generating portion during the fixing operation increases, and hence the heat generation efficiency improves.

The sectional area Sr' of the root portion 23*b* of the convex-shaped part 23*a* of the inside core 23 and the area Sf' of the surface of the leading end protruding portion 23*d* of the inside core 23, which is opposed to the belt 15A, can have a relationship similar to Expressions (1) and (2) of the first embodiment. That is, the inside core 23 may be designed to satisfy Expressions (8) and (9) below.

$$Bf'=Sr'Br'/nSf' \quad \text{Expression (8)}$$

$$nSf'<Sr'$$

$$Bf'<B\max<Bst \quad \text{Expression (9)}$$

Br': magnetic flux density of root portion 23*b* of convex-shaped part 23*a* of inside core 23

Bf': magnetic flux density of leading end portion 23*c* of convex-shaped part 23*a* of inside core 23

Bmax: maximum magnetic flux density

Bst: saturation magnetic flux density n: number of branches of leading end portion 23*c* (two in this embodiment)

A height L' of the leading end protruding portion 23*d* of the inside core 23 can use Expressions (4) and (5) described in the section of (Magnetic Flux Splitting Mechanism) of the first embodiment. That is, the height L' can be set to such a length that the magnetic flux passing through an air layer of the leading end portion 23*c* becomes negligibly smaller than the magnetic flux passing in the leading end protruding portions 23*d*.

Substantially, when the structure of the leading end portion 23*c* of the inside core 23 is determined so as to satisfy Expressions (8) and (9) as the heating-type fixing device for use in the image forming apparatus such as a printer, a copying machine, and a facsimile machine, the following may be achieved. When the height L' is set to a length of several mm, the magnetic resistance of the air layer of the leading end portion 23*c* becomes significantly larger than the magnetic resistance inside the leading end protruding portions 23*d*, and the magnetic flux passing through the air layer becomes negligibly small. Further, from the above-mentioned reason, the air layer between the leading end protruding portions 23*d* of the inside core 23 may be filled with a non-magnetic member.

Through adoption of the above-mentioned configuration, also in the IH-ODF fixing device F, the heat generation efficiency may be improved owing to the concentration of the magnetic flux. In the following, an example is described in which the third embodiment is applied to the conventional fixing device which operates at a frequency of 20 kHz or more, has a total power of 1,400 W, and uses 81% to 85.5% of the total power for heat generation.

A core having a saturation magnetic flux density of 500 mT or more is used as the outside core 12 and the inside core 23 of the device of FIG. 15. A magnetic field oscillating frequency is 20 kHz or more, and the fixing device drives the fixing belt 15A of ϕ30 at 310 rpm. The distance h between outside core 12 and the fixing belt 15A is set to 4 mm, and the total area 2Sf of the surface of the leading end portion 12*c* is set to half of the total area in the conventional case (2Sf/Sr=½). When a distance between the leading end portions of the second core portion 12*a* of the outside core 12 and the leading end portions of the convex-shaped part 23*a* of the inside core 23 is set to 7.5 mm, the magnetic flux density at a certain moment on the fixing belt surface immediately below the leading end portion is as shown in the graph of FIG. 17.

The magnetic field oscillating frequency is 20 kHz, and the moving speed of the surface of the fixing belt 15A is 500 mm/s. Therefore, one period is extremely short relative to the time interval of the moving speed of the surface of the fixing belt 15A, and hence it can be deemed that the magnetic flux is present almost constantly with respect to the moving speed of the fixing belt 15A. Therefore, when a certain point on the fixing belt 15A is focused, an eddy current proportional to the magnetic field gradient of FIG. 17 and the moving speed of the fixing belt is generated. The eddy current thus generated obeys Expression (8) similarly to the case of the first embodiment.

The fixing belt 15A moves in the x direction of the graph of FIG. 17. There are two peaks in the magnetic flux density, and the leading end protruding portion 23*d* on the inside core 23 side is at the position corresponding to the leading end protruding portion 12*d* on the outside core side, and hence the magnetic flux is more likely to concentrate than in the first embodiment, and the gradient of the magnetic flux density increases in each peak. Referring to the graph of FIG. 17, the peak of the magnetic flux has narrower skirts as compared to the case of the first embodiment, and is independently present. Thus, the generation amount of the eddy current is as follows.

$$4\Delta B \cdot v/\Delta x \qquad \text{Expression (14)}$$

Referring to Expression (14) and the graph of FIG. 17, when the cores 12 and 23 having the above-mentioned configuration are applied to the conventional fixing device, an improvement in heat generation efficiency of 5.4% is estimated. Further, the heat generation efficiency can be determined by a method similar to the case of the first embodiment by replacing the fixing roller 15 of FIGS. 8A and 8B with the fixing belt 15A.

Fourth Embodiment

Figure 18:
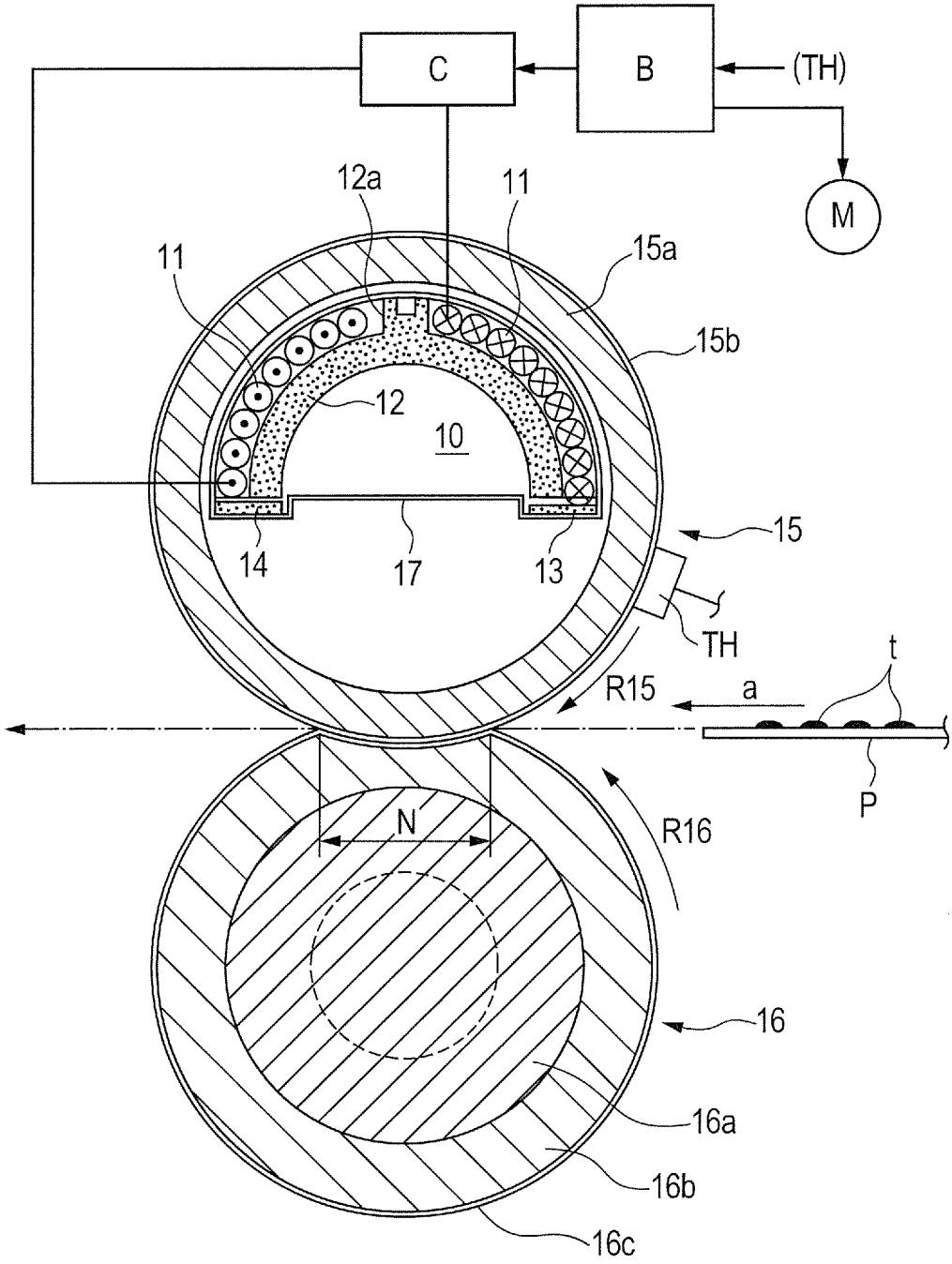
FIG. 18 is a schematic lateral sectional view of a main part of a fixing device according to a fourth embodiment.

As illustrated in FIG. 18, it is also possible to arrange the heating assembly 10 as the magnetic flux generating unit inside the fixing roller 15 as the heating rotary member in the fixing device F of the first and second embodiments, to thereby form an inside heating type image heating device employing an induction heating system.

Figure 19:
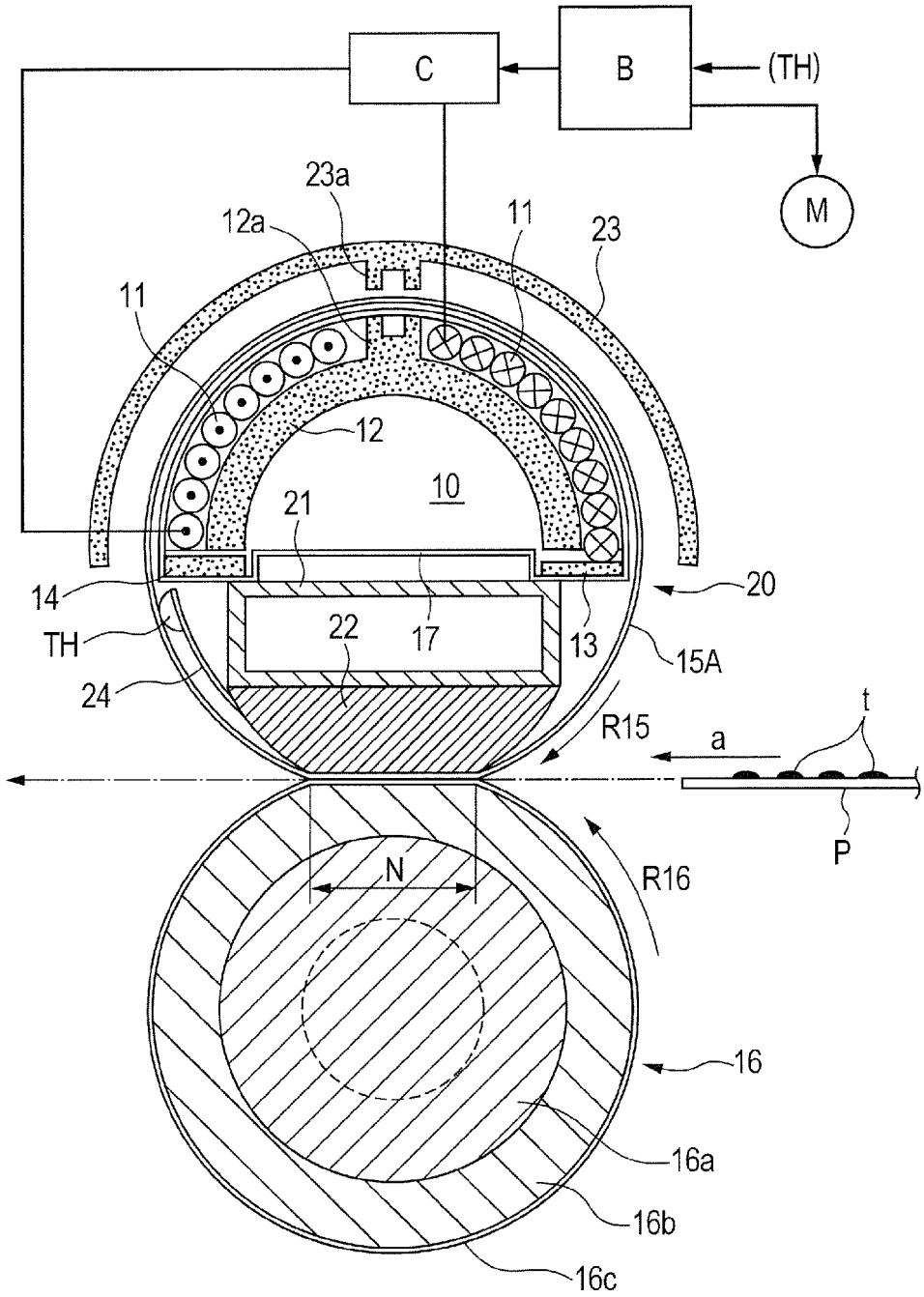
FIG. 19 is a schematic lateral sectional view of a main part of another fixing device according to the fourth embodiment.

In addition, as illustrated in FIG. 19, it is possible to arrange the heating assembly 10 as the magnetic flux generating unit inside the fixing belt 15A as the heating rotary member in the IH-ODF fixing device F of the third embodiment, to thereby form an inside heating type image heating device employing an induction heating system. In this case, the core 12 on the heating assembly 10 side is the inside core, and the core 23 arranged outside the belt 15A so as to be opposed to the heating assembly 10 while covering the belt 15A is the outside core.

Other Device Configurations

1) The rotatable heating rotary member may be formed into a form of an endless belt which circulates and moves while being suspended in a tensioned state by multiple belt supporting members.

2) The image pressurizing member may also be heated by a heating unit. Further, the image pressurizing member may be formed into a form of a non-rotary member, such as a pressure pad, which has a surface that can exhibit slipping performance.

3) The image heating device is not limited for use as the fixing device F of the embodiments. The image heating device may also be effectively used as a glossiness increasing device (image modification device) for heating an image that has been fixed onto the recording material to increase the glossiness of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent configurations and functions.

This application claims the benefit of Japanese Patent Application No. 2011-234895, filed Oct. 26, 2011, which is hereby incorporated by reference herein in its entirety.

What is claimed is:

1. An image heating device, comprising:

a coil configured to generate a magnetic flux;

a heating rotary member which generates heat by the magnetic flux generated from the coil and heats an image on a recording material;

a first core portion curved along a circumferential direction of the heating rotary member; and a second core portion extending toward the heating rotary member, the second core portion having a leading end portion which is opposed to the heating rotary member and a root portion, and the leading end portion having a thickness thinner than a thickness of the root portion in the circumferential direction of the heating rotary member, and wherein the thickness of the leading end portion is set so that the maximum magnetic flux density at the leading end portion is smaller than the saturation magnetic flux density of the second core portion.

2. An image heating device according to claim 1, wherein the second core portion is arranged inside winding of the coil.

3. An image heating device according to claim 1, wherein the leading end portion of the second core portion, which is opposed to the heating rotary member, has a plurality of leading end protruding portions.

4. An image heating device according to claim 3, wherein the leading end protruding portions are provided at different positions in a moving direction of the heating rotary member, and the leading end protruding portions are arranged at an interval so that magnetic fluxes generated from the leading end protruding portions are prevented from interfering with each other in the heating rotary member.

5. An image heating device according to claim 1, wherein the second core portion has a tapered shape.

6. An image heating device, comprising:

a coil configure to generate a magnetic flux;

a heating rotary member which generates heat by the magnetic flux generated from the coil and heats an image on a recording material;

a first core portion curved along a circumferential direction of the heating rotary member;

a second core portion extending toward the heating rotary member, the second core portion having a leading end portion which is opposed to the heating rotary member and a root portion, and the leading end portion having a thickness thinner than a thickness of the root portion in the circumferential direction of the heating rotary member, wherein the second core portion is arranged inside winding of the coil; and a third core portion arranged outside the winding of the coil and extending toward the heating rotary member, the third core portion having a leading end portion which is opposed to the heating rotary member and a root portion, and the leading end portion of the third core portion having a thickness equivalent to a thickness of the root portion of the third core portion in the circumferential direction of the heating rotary member.

7. An image heating apparatus comprising:

an image heating member configured to heat a toner image on a recording material;

an excitation coil provided outside the image heating member and configured to generate magnetic flux for electromagnetic induction heating of said image heating member; and a plurality of magnetic cores arranged along a longitudinal direction of said image heating member and configured to direct the magnetic flux toward the image heating member, each of the magnetic cores including (i) a first magnetic core portion curved substantially along a circumferential direction of the image heating member and opposed to the image heating member through the excitation coil, and (ii) a second magnetic core portion projected toward a winding center of the excitation coil and opposed to the image heating member not through the excitation coil, wherein each of the second magnetic core portions includes a root portion, and a leading end portion (i) which is closer to the image heating member than the root portion and (ii) which has a cross sectional area smaller than that of the root portion so that the maximum magnetic flux density at the leading end portion is smaller than the saturation magnetic flux density at the root portion.

8. The image heating apparatus according to claim 7, wherein the leading end portion has a plurality of protruding portions, and the cross sectional area of the leading end portion is the sum of the cross sectional area each of the protruding portions.

9. An image heating apparatus comprising:

an image heating member configured to heat a toner image on a recording material;

an excitation coil provided inside the image heating member and configured to generate magnetic flux for electromagnetic induction heating of the image heating member;

a plurality of magnetic cores arranged along a longitudinal direction of the image heating member and configured to direct the magnetic flux toward the image heating member, each of the magnetic cores including (i) a first magnetic core portion curved substantially along a circumferential direction of the image heating member and opposed to the image heating member through the excitation coil, and (ii) a second magnetic core portion projected toward a winding center of the excitation coil and opposed to the image heating member not through the excitation coil, wherein each of the second magnetic core portions includes a root portion, and a leading end portion (i) which is closer to the image heating member than the root portion and (ii) which has a cross sectional area smaller than that of the root portion so that the maximum magnetic flux density at the leading end portion is smaller than the saturation magnetic flux density at the root portion.

10. The image heating apparatus according to claim 9, wherein the leading end portion has a plurality of protruding portions, and the cross sectional area of the leading end portion is the sum of the cross sectional area each of the protruding portions.

* * * * *